US008333037B2

(12) United States Patent
Sullivan

(10) Patent No.: US 8,333,037 B2
(45) Date of Patent: Dec. 18, 2012

(54) PET DOOR MODULE WITH INTEGRAL SECURITY PANEL AND CASSETTE PORTAL

(75) Inventor: Thomas D. Sullivan, Hamilton, NJ (US)

(73) Assignee: Accession, Inc., Hamilton, NJ (US)

( * ) Notice: Subject to any disclaimer, the term of this patent is extended or adjusted under 35 U.S.C. 154(b) by 345 days.

(21) Appl. No.: 12/799,304

(22) Filed: Apr. 22, 2010

(65) Prior Publication Data

US 2010/0269413 A1 Oct. 28, 2010

Related U.S. Application Data

(60) Provisional application No. 61/214,783, filed on Apr. 28, 2009.

(51) Int. Cl.
*E05D 15/48* (2006.01)

(52) U.S. Cl. ..... 49/169; 49/163; 49/170; 160/90; 160/97; 160/180; 160/105; 52/204.51; 52/207

(58) Field of Classification Search ..... 49/163, 49/169, 170; 52/204.51, 207; 160/40, 90, 160/97, 105, 180
See application file for complete search history.

(56) References Cited

U.S. PATENT DOCUMENTS

| | | | | |
|---|---|---|---|---|
| 2,595,975 | A | 5/1952 | Nothdurft | 160/91 |
| 2,758,646 | A * | 8/1956 | Johnson | 160/354 |
| 3,420,001 | A | 1/1969 | Raymon | 49/407 |
| 3,471,189 | A * | 10/1969 | Ness | 292/266 |
| 3,654,733 | A | 4/1972 | Blackwell | 49/168 |
| 3,811,224 | A | 5/1974 | Garrison | 49/168 |
| 3,816,967 | A | 6/1974 | Littrell | 49/449 |
| 3,878,645 | A | 4/1975 | Porter | 49/169 |
| 4,047,331 | A * | 9/1977 | Davlantes | 49/171 |
| 4,322,913 | A | 4/1982 | Himmer | 49/168 |
| 4,385,470 | A | 5/1983 | Bryson et al. | 49/63 |
| 4,408,416 | A * | 10/1983 | Davlantes | 49/168 |
| 4,651,793 | A * | 3/1987 | Davlantes | 160/92 |
| 4,754,797 | A | 7/1988 | Sronce | 160/354 |
| 4,760,872 | A * | 8/1988 | Hale, Jr. | 160/90 |
| 4,776,133 | A | 10/1988 | Green | 49/394 |
| 4,927,198 | A | 5/1990 | Fennell et al. | 292/306 |
| 5,185,954 | A * | 2/1993 | Waddle, Sr. | 49/168 |
| 5,269,097 | A | 12/1993 | Davlantes | 49/169 |
| 5,287,654 | A | 2/1994 | Davlantes | 49/169 |
| 5,551,188 | A | 9/1996 | Davlantes | 49/169 |
| 5,603,190 | A | 2/1997 | Sanford | 52/202 |
| 5,735,079 | A * | 4/1998 | Davlantes | 49/169 |
| 5,906,070 | A | 5/1999 | Boerhave | 49/207 |
| 5,946,855 | A | 9/1999 | Miconi | 49/163 |
| 6,272,793 | B1 | 8/2001 | Davlantes | 49/168 |
| 6,691,483 | B2 | 2/2004 | Lethers | 52/455 |
| 7,063,123 | B2 | 6/2006 | Lethers | 160/180 |
| 7,207,141 | B2 * | 4/2007 | Sullivan | 49/169 |
| 7,363,956 | B2 | 4/2008 | Lethers | 160/180 |
| 7,798,103 | B2 * | 9/2010 | Bosserdet et al. | 119/501 |
| 2008/0163550 | A1 * | 7/2008 | Lomax et al. | 49/169 |

* cited by examiner

*Primary Examiner* — Katherine W Mitchell
*Assistant Examiner* — Marcus Menezes
(74) *Attorney, Agent, or Firm* — Watov & Kipnes, P.C.; Kenneth Watov

(57) ABSTRACT

The present pet door panel or module includes an interior pocket flap assembly cassette opening and an external frame forming a security panel track permitting a flap assembly cassette and security panel to be slidably received or removed to facilitate changing the height of the portal opening in the pet door panel or module to accommodate various size pets in the field by the consumer without the need for tools.

17 Claims, 26 Drawing Sheets

PET DOOR MODULE WITH INTEGRAL SECURITY PANEL AND CASSETTE PORTAL

RELATED PATENT, AND APPLICATION

The present invention is related to U.S. Pat. No. 7,207,141, entitled "Sliding Door Insert for Portable Pet Portal," issued on Apr. 24, 2007. The present invention also takes priority from co-pending Provisional Application No. 61/214,783, filed on Apr. 28, 2009. The teachings of the related Patent, and co-pending Provisional Application, are incorporated herein by reference to the extent that they do not conflict herewith.

FIELD OF THE INVENTION

The present invention relates generally to pet doors, and more particularly to pet doors facilitating changing the height of the portal opening to accommodate pets of various sizes, and securing the portal opening.

BACKGROUND OF THE INVENTION

Current state-of-the-art one piece pet door panels either do not typically allow for adjustability of the associated pet portal or, if they do, require tools, disassembly and reassembly of the lowermost portion of the pet door panel by the consumer. Another method of changing the height of the pet portal is accomplished as described in U.S. Pat. No. 7,207,141, wherein the pet door panel consists of three modules, the bottom module contains the pet portal and flap assembly while the center and top modules are essentially solid filler pieces. The height of the pet portal is accomplished by removing the screws that attach the portal frame and flap assembly to the lower module, removing the frames and flap assembly, inverting the bottom module to change the height of the rise of portal opening, reinserting and attaching the frames and flap assembly to the bottom module.

Known current one piece pet door panels for sliding patio doors do not have a pet portal height adjustability feature, and require tools to disassemble and reassemble the lowermost portion thereof, which typically includes a frame designed to accommodate a separate security panel to be placed over the portal opening to prevent a pet from using the portal. Although, the pet door panel described in U.S. Pat. No. 7,207,141 incorporates the security panel as an integral part of the flap assembly, there remains a need for a tool and some disassembly and reassembly to remove and reinsert the frames and flap assembly when changing the height of the pet portal. This same level of disassembly and reassembly of the flap assembly and security panel frames is required when it is time for the consumer to replace a worn component such as the flap in the field.

Accordingly, there is a need for a pet door panel adapted to facilitate the easy removal of the flap assembly and the security panel frame when changing the height of the pet portal opening in the field. There is a further need to facilitate easy removal of the flap assembly and the security panel frame when the consumer attempts to service the pet portal flap assembly in the field.

SUMMARY OF THE INVENTION

The present invention relates generally in one embodiment to a pet door panel or module adapted to facilitate changing of the height of the pet portal or servicing of the flap assembly without requiring tools and extensive disassembly and reassembly by the consumer in the field. The pet door panel includes a bottom module housing a flap assembly cassette and removable security panel. The flap assembly cassette consists of the pet portal flap, flap keeper, and a magnetic sealing bar attached to a cassette frame that is inserted through a slot in the trailing side of the bottom module. The bottom module includes tracks on opposing front and back faces for slidably receiving channels of the security panel to both secure the pet portal opening, and/or to prevent the pet from using the pet portal. The integral security panel track design in the bottom module eliminates the need for a separate frame to accommodate the security panel.

The present invention is in another embodiment operatively associated with a modular component pet access door designed for use in sliding glass patio doors. The modular construction permits the apparatus to be packaged and stored in a portable compact container when in a disassembled state. The compact size of the disassembled unit minimizes storage space requirements while facilitating transportation opportunities by the retailer and consumer. Modular construction and the design of components permit the invention to be changed in the field to accommodate a variety of styles and sizes of sliding glass patio doors. The universal nature of the modular construction and component system enhances the portability of the apparatus and permits the pet access door to be adjusted in the field to accommodate a growing pet or a new pet.

The present invention does not require tools to install, nor does it require modification to any component of an existing sliding glass patio door. When assembled the modules and components create a sliding glass patio door pet access door panel.

The present invention is designed for simple assembly in the field by the consumer. Once assembled the panel may be installed and removed as one piece. The leading edge of the panel is designed to fit into the moveable sliding door side of the patio doorframe to create a secure fit and effective weather seal.

BRIEF DESCRIPTION OF THE DRAWINGS

The following drawings are illustrative of embodiments of the present invention and are not intended to limit the invention as encompassed by the claims forming part of the application, wherein like items are identified by the same reference designations:

DETAILED DESCRIPTION OF THE INVENTION

Figure 1:
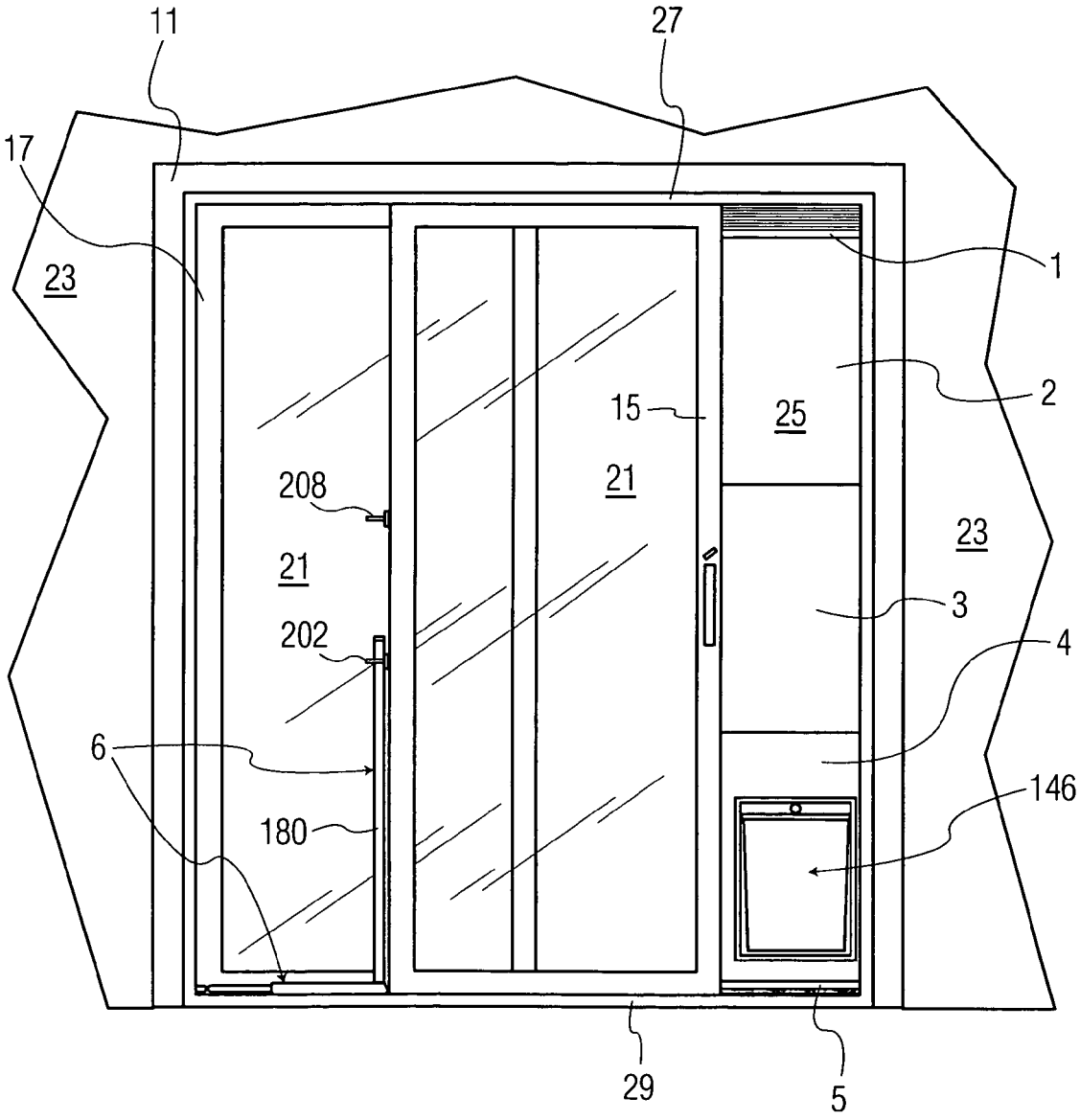
FIG. 1 is a front or interior elevational view of the pet access door installed in a sliding glass patio door with the moveable sliding door in a closed position, providing partial access through the sliding glass door when the moveable sliding door is moved to an open position, for various embodiments of the invention absent a storm window.
Figure 2:
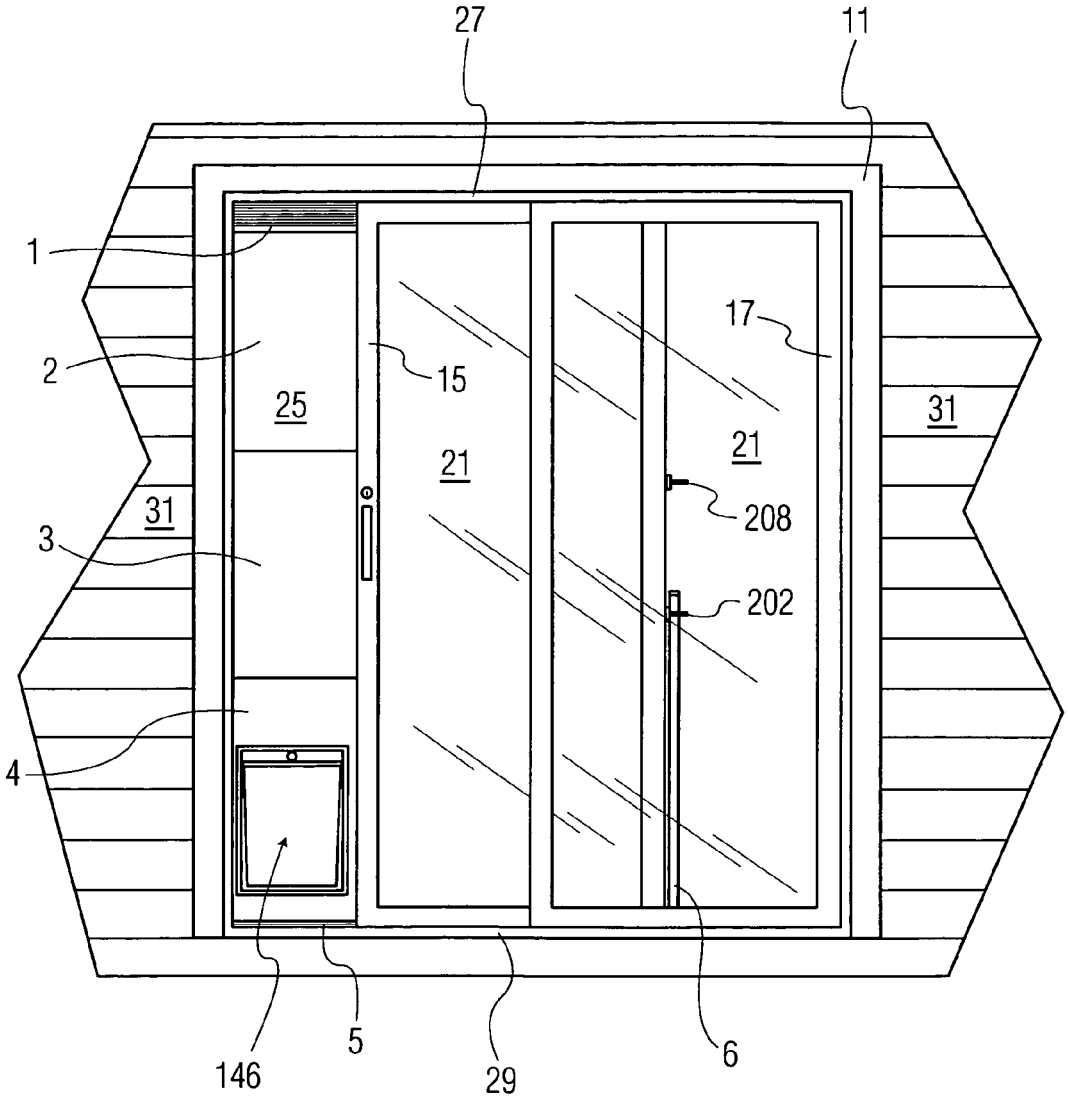
FIG. 2 is a back or exterior elevational view of the pet access door of FIG. 1 installed in a sliding glass patio door with the moveable sliding door in a closed position, providing partial access through the sliding glass door when the moveable sliding door is moved to an open position.

As shown in FIGS. 1-3A to 3F, for one embodiment of the invention, pet door panel 25, is installed between the sliding door frame 11, and the leading side of frame 15 on movable sliding door 21, to provide a means of ingress and egress for a pet. Drop lock security lock 6 is installed on the interior side of stationary sliding door 21, between sliding door frame 11, and the trailing side of frame 15 on movable sliding door 21, to secure pet door panel 25 between sliding door frame 11 and the leading side of frame 15 on movable siding door 21, to prevent movable sliding door 21 from being opened with pet door panel 25 installed. Sliding door frame 11 is typically secured to a building structure 23, such as a home or office. For illustrative purposes all elevational views, except as noted, depict the sliding glass patio door in a right opening configuration. Therefore, when describing various elements of the invention reference made to right and left side views pertains to installation of the invention in a right opening sliding glass door configuration. However, since the invention may be installed in either a right or left opening sliding glass patio door configuration the term left or right is relative, therefore, the terms leading, trailing, interior and exterior are used in combination or in place of the terms right and left side and front and back views where referenced.

The sliding door frame 11 has a lower track portion 29 and an upper track portion 27. The lower track portion 29 slideably receives at least one sliding door member 21 therein. A complementary upper track portion 27 is typically positioned on the upper side of the siding glass door frame 11, in alignment with the lower track portion 29, enabling the sliding door member 21 to be slideably moved between open and closed positions within the sliding door frame 11.

Figure 3A:
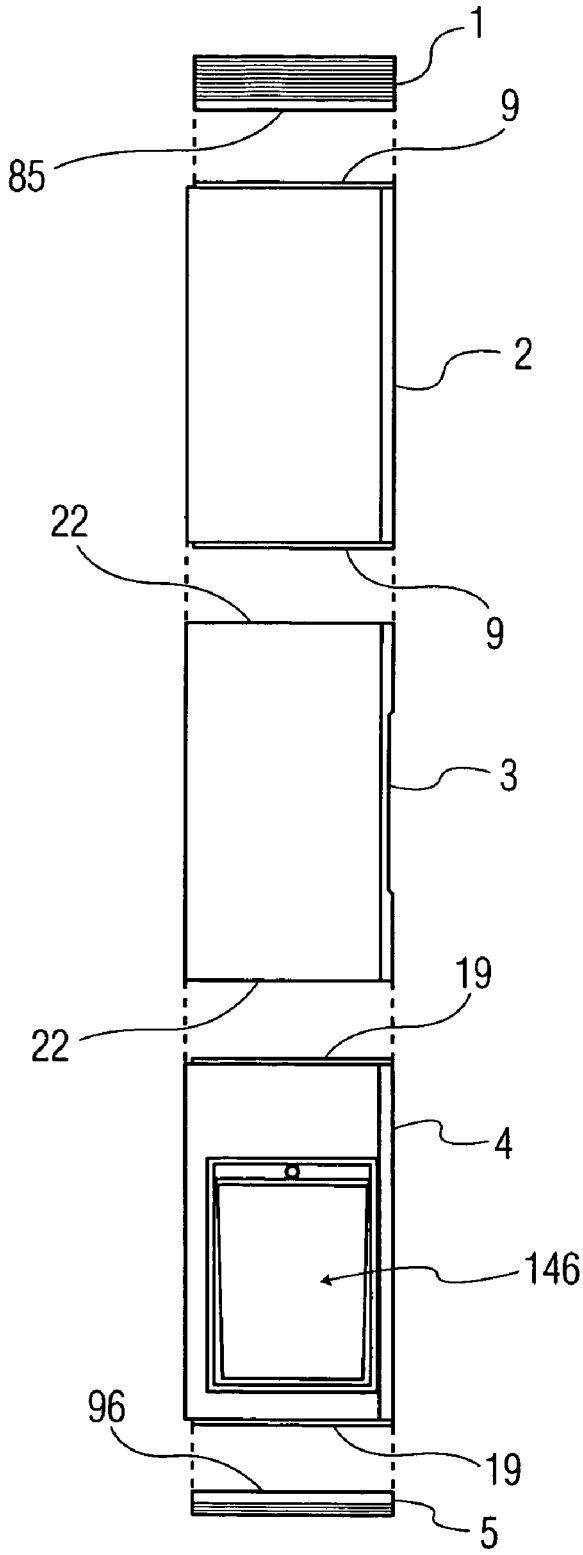
FIGS. 3A-3C show front elevational assembly views of the five primary modules and components comprising the pet access door panel of FIG. 1, and illustrate how the modules and components slide together to assemble the pet access door.
Figure 3B:
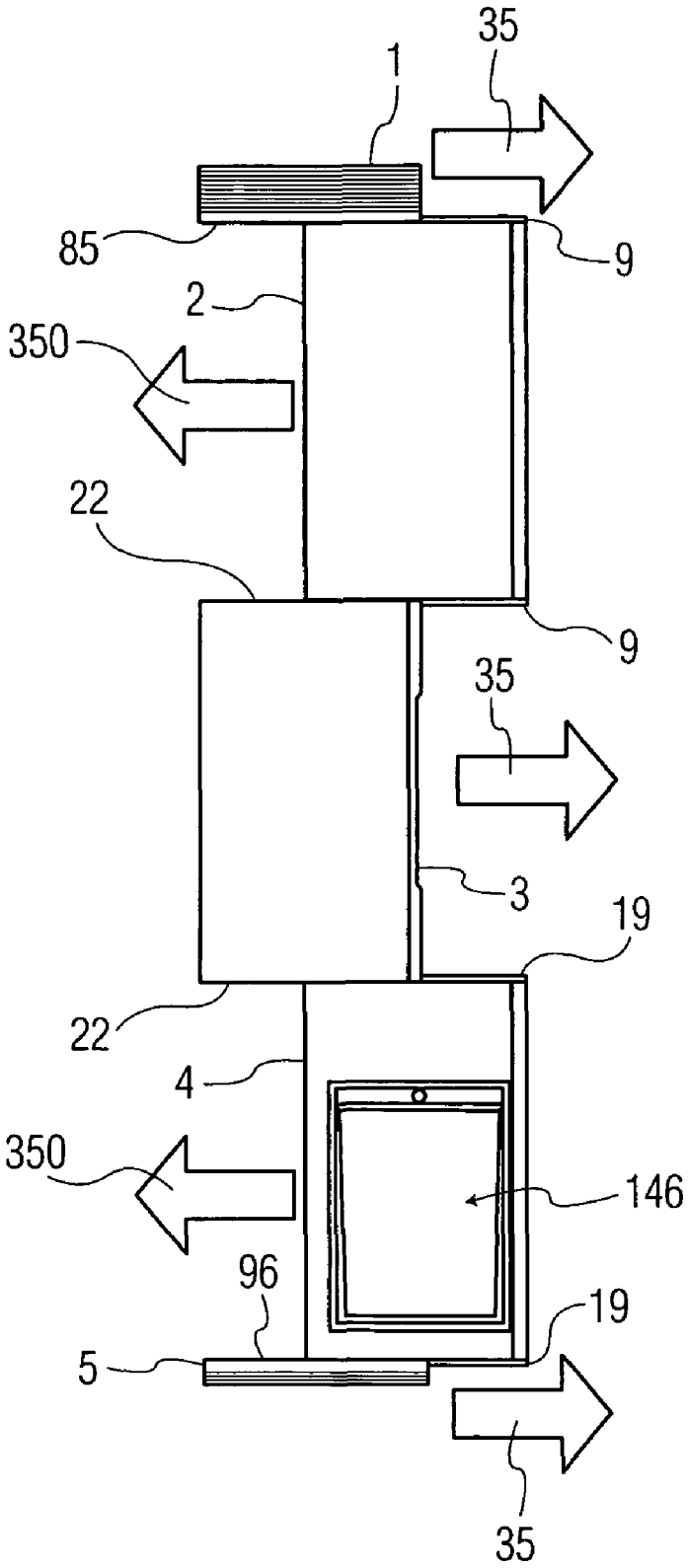

The various embodiments of the invention include a pet door panel 25 with pet portal 146, drop lock security lock 6 with locking bracket 202, and storage bracket 208. As shown in FIG. 3A, pet door panel 25 is an assembly consisting of five primary components; top module weather seal 1, top module 2, center module 3, bottom module 4 with pet portal 146 and bottom module weather seal 5. In this embodiment, the modules 2 and 3 are shown as being solid, but can be configured to include storm windows or screens. Top module weather seal 1, top module 2, center module 3, bottom module 4 with pet portal 146, and bottom module weather seal 5 are slideably attached to one another for assembly, disassembly, or replacement, as shown in FIG. 3B, via an interlocking tongue and groove system integral to each component. More particularly, interlocking groove 85, located in the lowermost portion of top module weather seal 1, is slideably attached to interlocking tongue 9 located on the uppermost portion of top module 2, as indicated by directional arrow(s) 35 and/or 350. Interlocking tongue 9, located on the lowermost portion of top module 2, is slideably attached to interlocking groove 22 located on the uppermost portion of center module 3, as indicated by directional arrows 35 and/or 350. Interlocking groove 22 located in the lowermost portion of center module 3 is slideably attached to interlocking tongue 19 located in the uppermost portion of bottom module 4 as indicated by directional arrows 35 and/or 350. Interlocking tongue 19 located in the lowermost portion of bottom module 4 is slideably attached to interlocking groove 96 located in the uppermost portion of bottom module weather seal 5 as indicated by directional arrows 35 and/or 350.

Figure 3C:
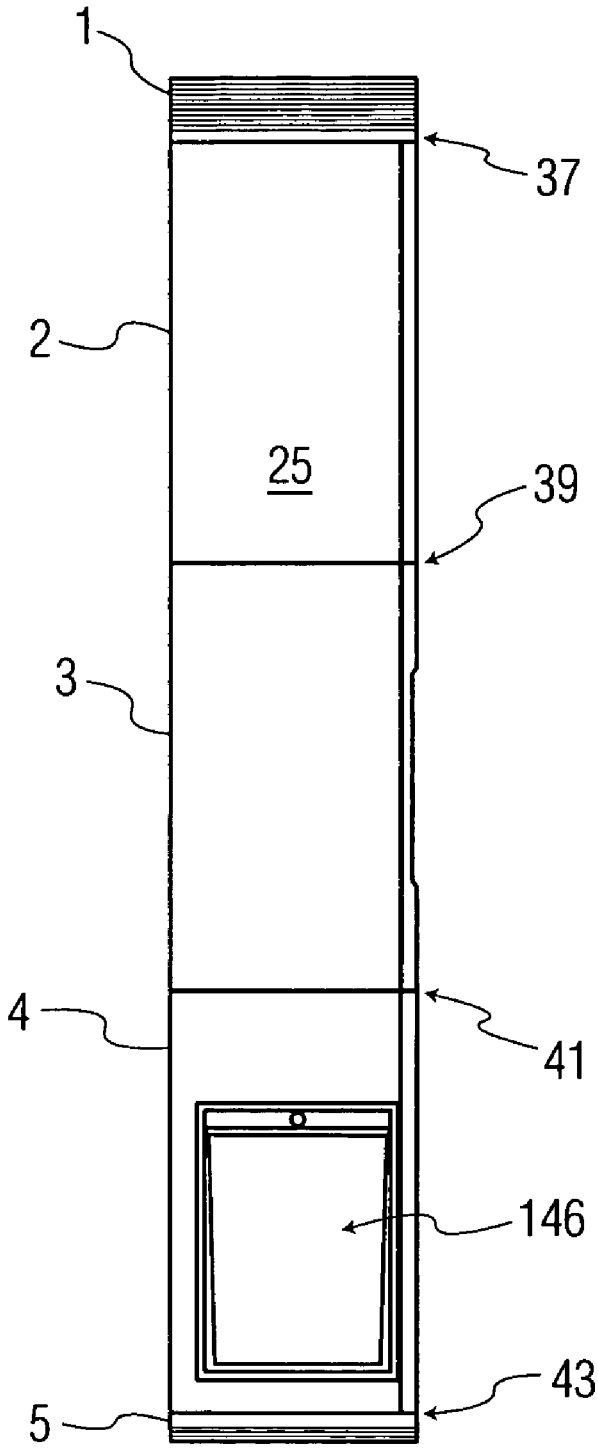

FIG. 3C shows assembled pet door panel 25 with pet portal 146. Top module weather seal 1 is attached to top module 2 at seam 37, top module 2 is attached to center module 3 at seam 39, center module 3 with pet portal 146 is attached to bottom module 4 at seam 41, and bottom module 4 with pet portal 146 is attached to bottom module weather seal 5 at seam 43.

Figure 3D:
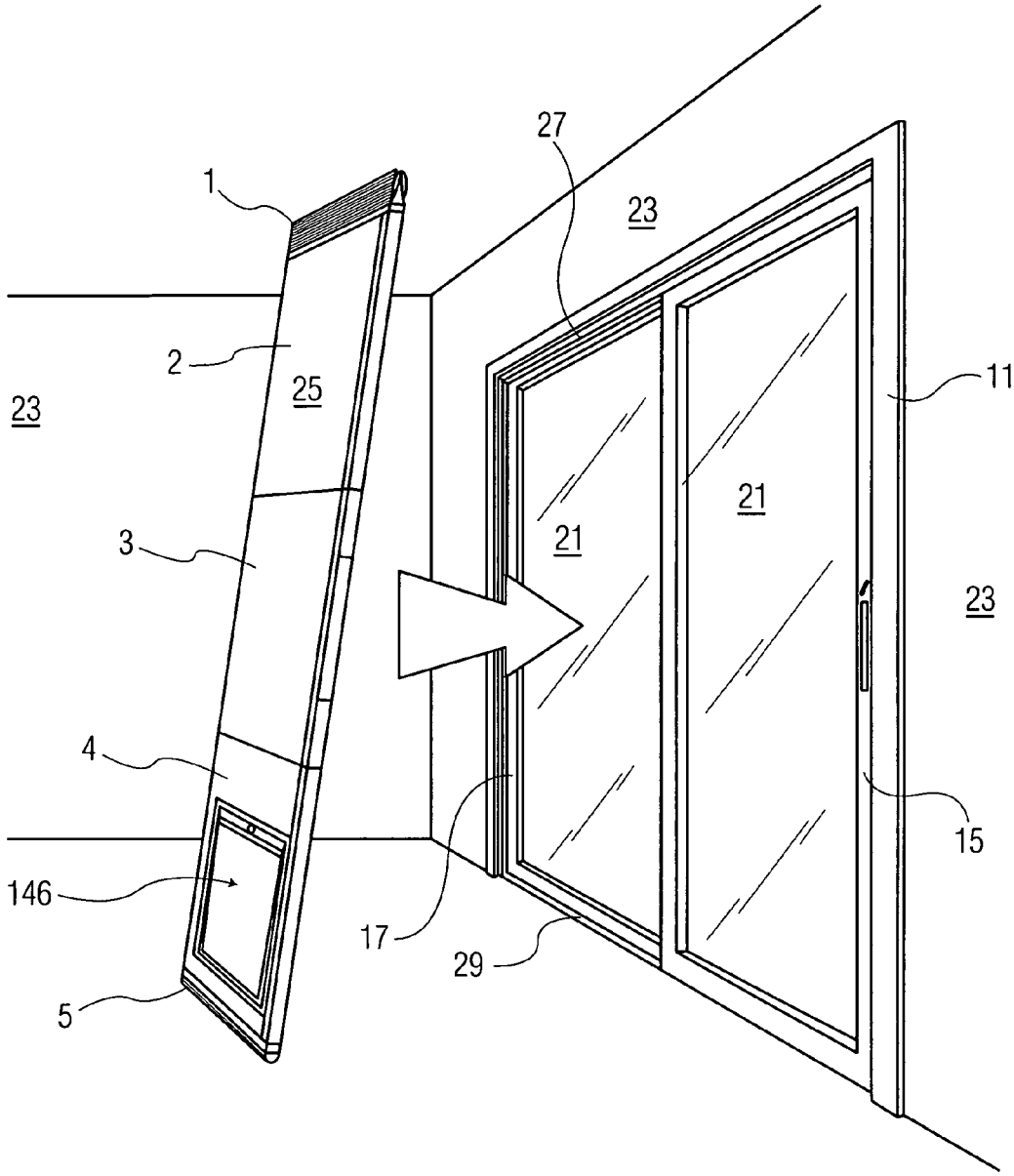
FIG. 3D is a perspective view illustrating the initiation of installation of the pet access door of FIG. 1 into a sliding glass patio door.
Figure 3E:
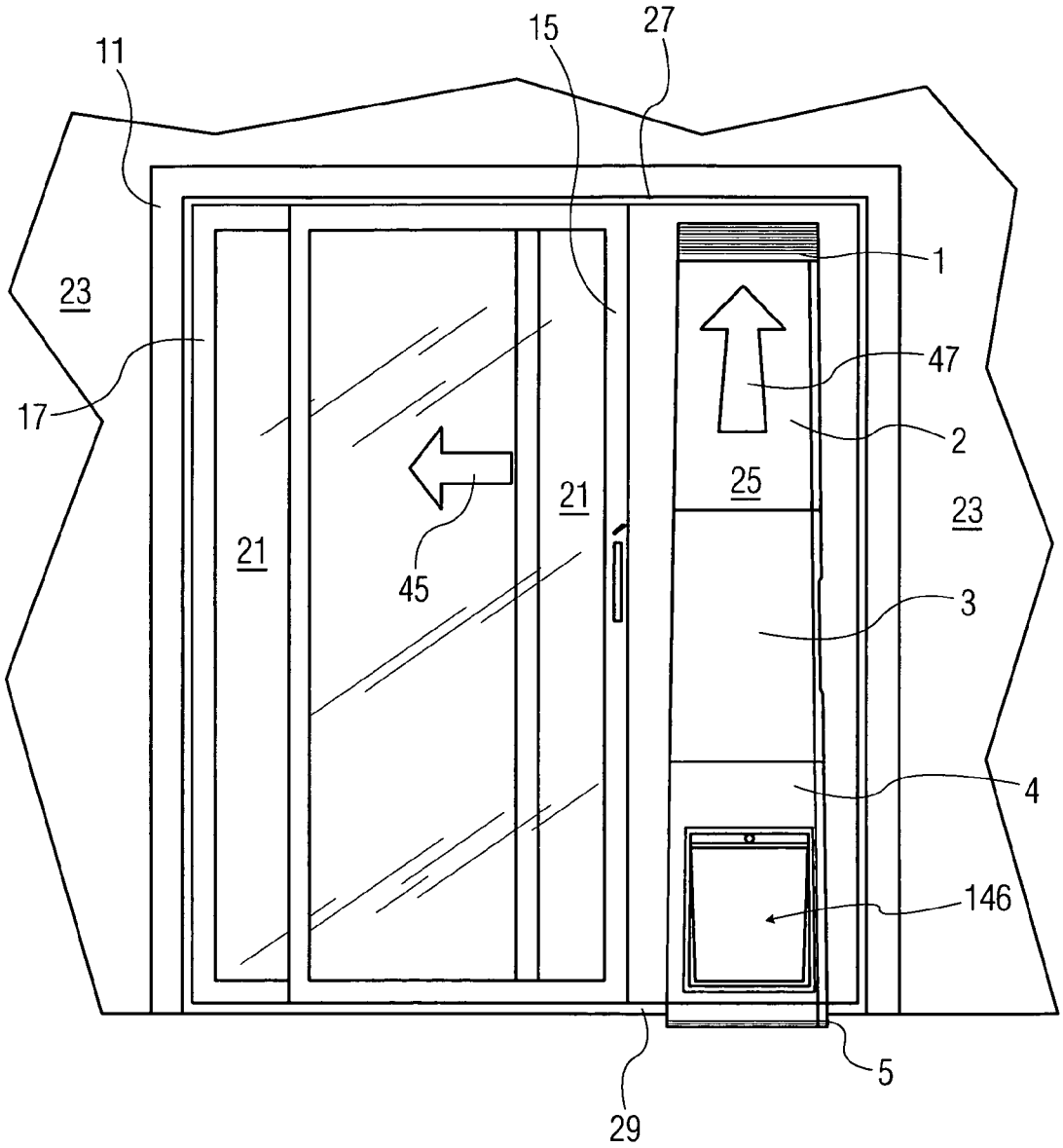
FIG. 3E is a partial perspective and elevational view illustrating a step in the installation of the pet access door of FIG. 1 into a sliding glass patio door.
Figure 3F:
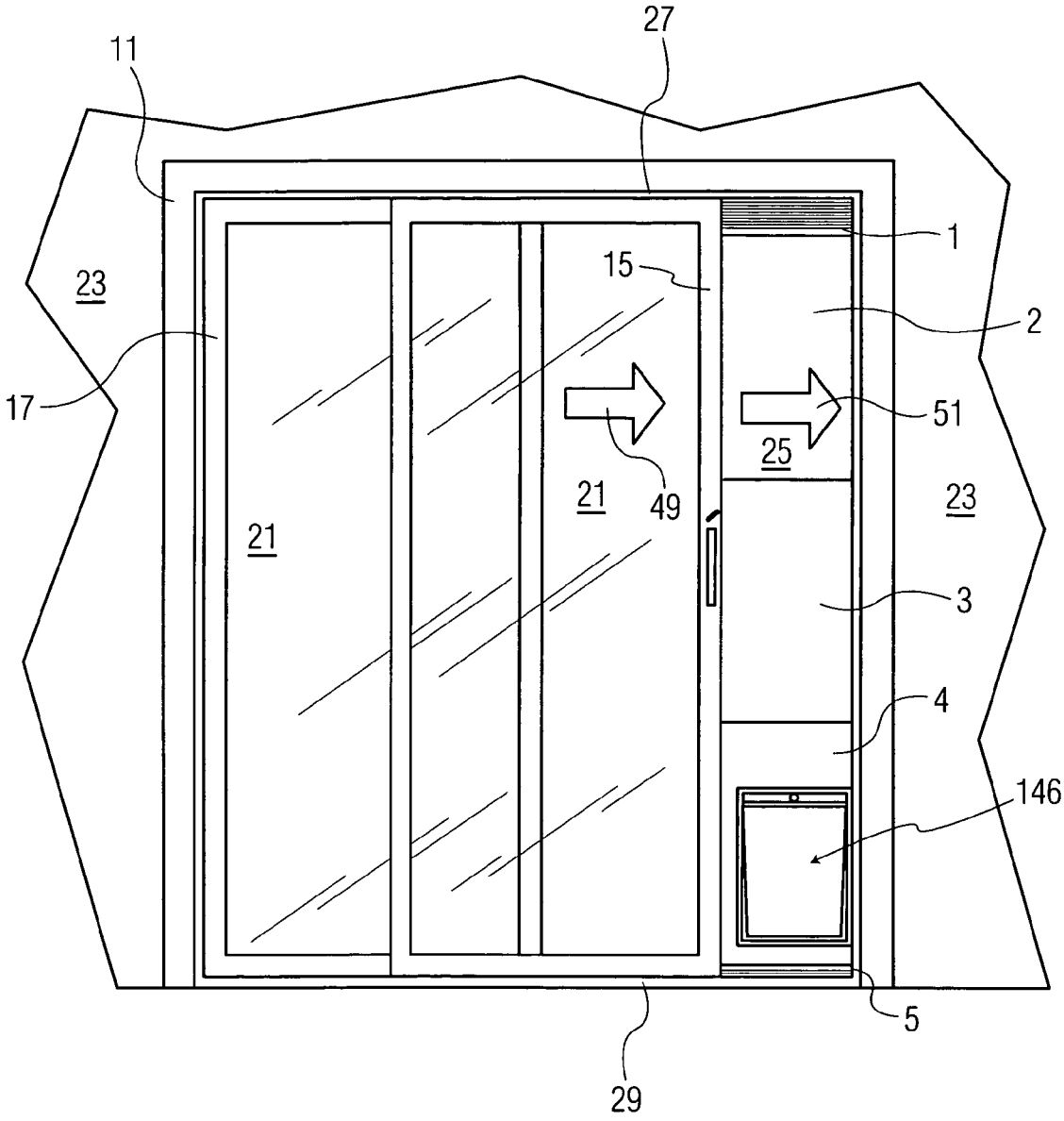
FIG. 3F is an elevational view illustrating a step in the installation of the pet access door of FIG. 1 into a sliding glass patio door.

FIGS. 3D-3F show installation of the assembled pet door panel 25 with pet portal 146 into an existing sliding glass door assembly. Although assembled pet door panel 25 may be assembled in place within sliding door frame 11, the preferred method of assembly is accomplished on a flat surface such as a floor or table top. When assembled outside of sliding door frame 11, the inventive assembled pet door panel 25 is brought to sliding door frame 11 as shown in FIG. 3D. FIG. 3E shows movable sliding glass door 21 being pulled away from sliding door frame 11 to open movable sliding glass door 21 as indicated by directional arrow 45, to permit pet door panel 25 to be installed. The top module weather seal 1 component located on the uppermost portion of assembled pet door panel 25 is lifted up into a recess of upper track portion 27 of sliding door frame 11, as shown in by directional arrow 47, and then rotated into alignment with the upper track portion 27 and a recess of lower track portion 29 of sliding door frame 11. The top module weather seal 1 is constructed to allow a spring loaded flexible sleeve to compress in order to fit pet door panel 25 between upper track portion 27 and lower track portion 29 of sliding door frame 11. When in alignment with upper track portion 27 and lower track portion 29 of sliding door frame 11, the bottom module weather seal 5 component located on the lowermost portion of assembled pet door panel 25 is lowered into the recessed lower track portion 29 of sliding door frame 11. As shown in FIG. 3F, after assembled pet door panel 25 is in place in upper track portion 27 and lower track portion 29 of sliding door frame 11, between the leading side of frame 15 on movable sliding glass door 21 and sliding door frame 11, movable sliding glass door 21 is pulled closed against assembled pet door panel 25 as indicated by directional arrow 49. In turn, assembled pet door panel 25 is pulled against sliding door frame 11 as indicated by directional arrow 51 restricting access through movable sliding glass door 21, while providing egress and ingress for pets through pet portal 146. Frame 15 of movable sliding glass door 21 abuts the trailing side of assembled door panel 25 within a channel formed by trailing side weather seal shims (not shown) in top module 2 and bottom module 4, and weather seal shims (not shown) in center module 3, that comprise assembled pet door panel 25, with assembled pet door panel 25 installed and movable sliding glass door 21 in a closed position. When installed, the leading side of assembled pet door panel 25 abuts sliding door frame 11.

After installation of assembled pet door panel 25 as described above, drop lock security lock 6 is installed between the trailing side of frame 15 on movable sliding glass door 21 by drop lock security lock 6 handlebar 180 and sliding door frame 11, as shown in FIG. 1. Drop lock security lock 6 consists of an adjustable lower housing assembly that sits in lower track portion 29 of sliding door frame 11 between the trailing side of frame 15 on movable sliding door 21 and sliding door frame 11 with assembled pet door panel 25 installed. Drop lock security lock 6 is attached to the trailing side of frame 15 on movable sliding door 21 by handlebar 180, and locking bracket 202 which is mounted on the trailing side of frame 15 of movable sliding door 21. Drop lock security lock 6 can be installed in any sliding glass door between the trailing side of frame 15 on movable sliding glass door 21 and sliding door frame 11, with or without assembled pet door panel 25 installed to prevent forced entry from the exterior or unintentional opening from the interior of the structure.

In another embodiment of the invention, drop lock security lock 6 is the primary means of locking movable sliding glass door 21 with assembled pet door panel 25 installed. In order to open movable sliding glass door 21, the handlebar 180 is rotated out of a locked position in locking bracket 202 and lifted to storage bracket 208 also located on the trailing side of frame 15 on movable sliding glass door 21. In so doing, security lock 6 is lifted out of lower track portion 29 of sliding door frame 11 allowing movable sliding glass door 21 to be pulled opened for passage or installation or removal of assembled pet door panel 25.

Top module 2, center module 3, and bottom module 4 are designed to be of an injection molded or injection blow molded polymer construction with a rigid insulation core. Wherever possible each of the components described herein are molded in one piece. This type of construction provides privacy while providing insulation quality superior to prior art. All three modules are designed to fit a variety of sliding glass patio door heights and door thicknesses through an adjustable top module weather seal 1 and left or trailing side and right or leading side weather seal shims 12 or 13, and 8, respectively.

Figure 4:
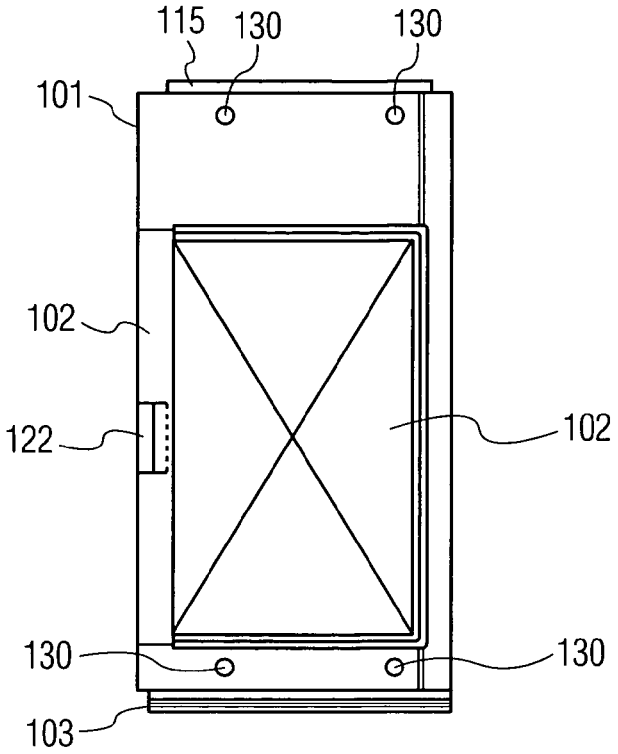
FIG. 4 is a front elevational view of the bottom module of the pet door panel with the security panel inserted for one embodiment of the present invention.
Figure 5:
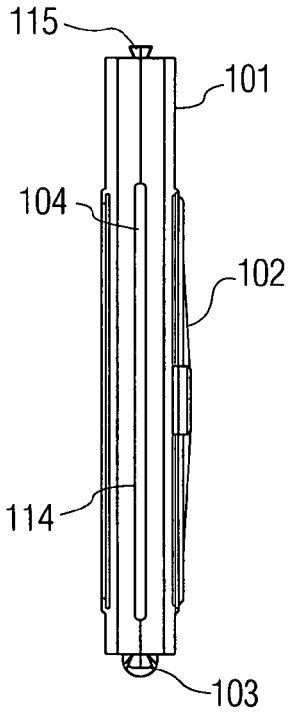
FIG. 5 is a trailing side view of the bottom module with the security panel and flap assembly cassette inserted.

A preferred embodiment of the invention is shown in FIGS. 4 through 32. In this preferred embodiment, as described in detail below, the bottom module 4 as shown and described above has been reconfigured and now referred to as bottom module 101. As reconfigured, the bottom module 101 now includes a security panel 102 and flap assembly cassette 104, which are shown in FIGS. 4 and 5, as installed in bottom module 101. Further details are provided below. Note that the circular indentations 130 are for receiving mounting prongs of a ramp or platform (not shown), for avoiding a pet having to step up to pass through the pet portal.

Figure 6:
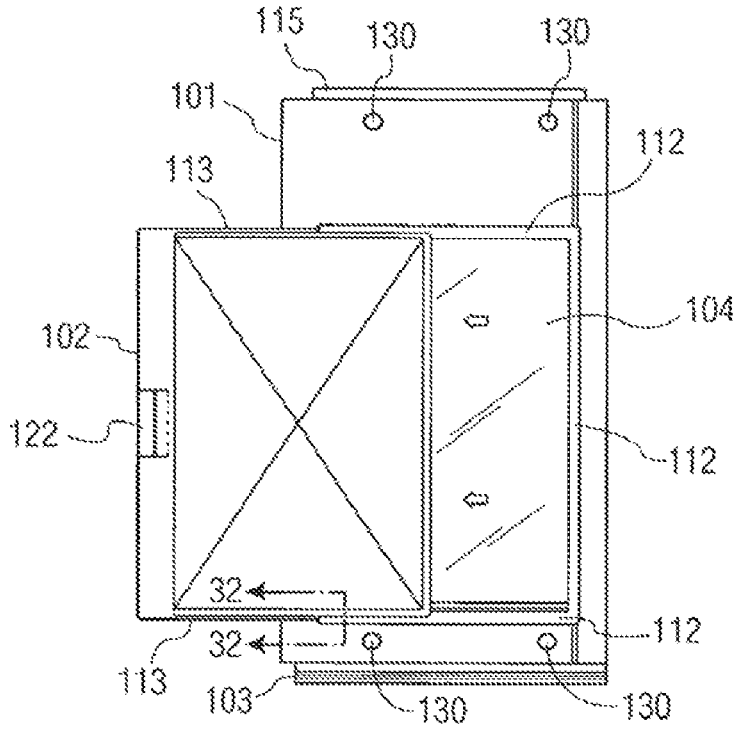
FIG. 6 is a front elevational view of the bottom module with the security panel partially removed exposing a portion of the flap assembly cassette.
Figure 7:
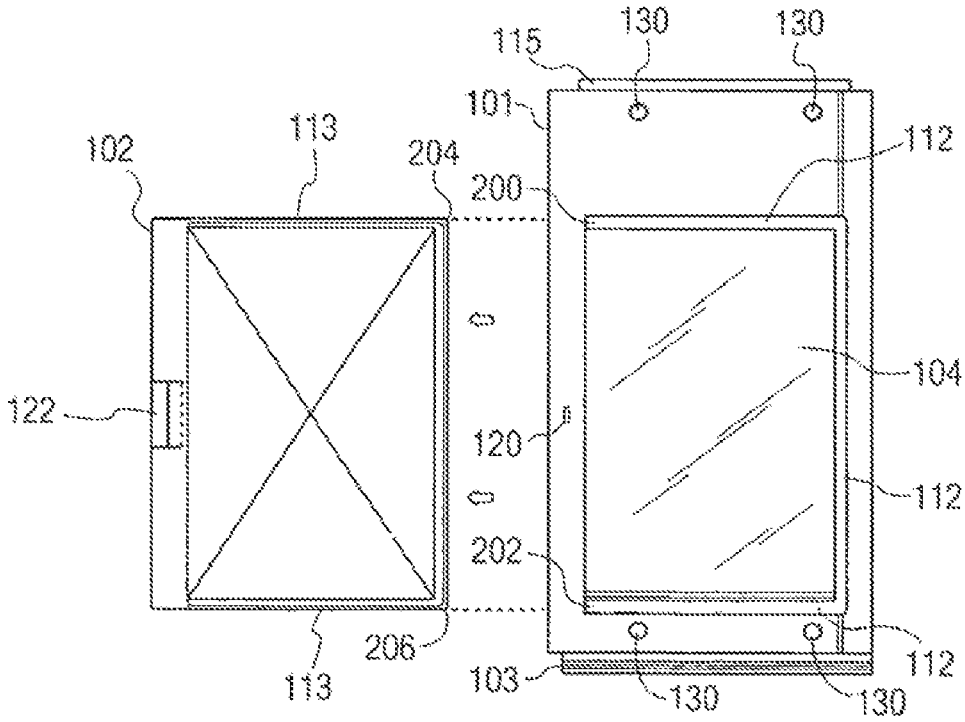
FIG. 7 is a front elevational and exploded assembly view of the security panel, bottom module and flap assembly cassette with the security panel completely removed from the bottom module in the low rise or small pet configuration.
Figure 8:
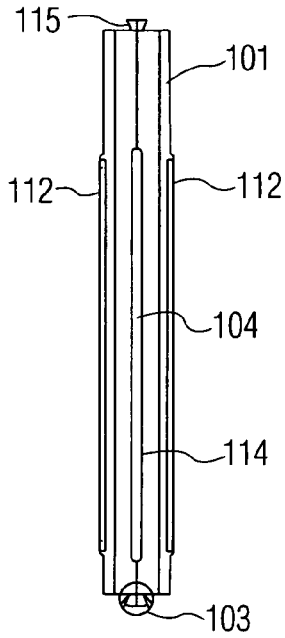
FIG. 8 is a trailing side view of the bottom module and flap assembly cassette with the security panel removed in the low rise or small pet configuration.

In one embodiment of the invention all three modules comprising the pet door panel are of a two-piece construction consisting of two halves that are joined together to form a single module. This type of construction permits for the forming of recesses on the interior sides of the module halves. These recesses for the security panel track 112 (see FIGS. 6 and 7) and the flap assembly cassette channel 114 (see FIG. 8) within the bottom module 101 when the halves are joined, as described in further detail below. FIG. 6 shows the bottom module 101 with the security panel 102 partially removed by sliding back on tracks 112 formed in the bottom module 101 exposing a portion of the flap assembly cassette 104. FIGS. 7 and 8 show front elevational and trailing edge views, respectively, of the bottom module 101 with flap assembly cassette 104 in place within flap assembly channel 114 and security panel 102 completely removed. Note in FIG. 7 that track 112 has free ends 200, 202 for receiving leading ends 204, 206, respectively, of security channel 113 to permit security panel 102 to be slid into bottom module 101.

Figure 9:
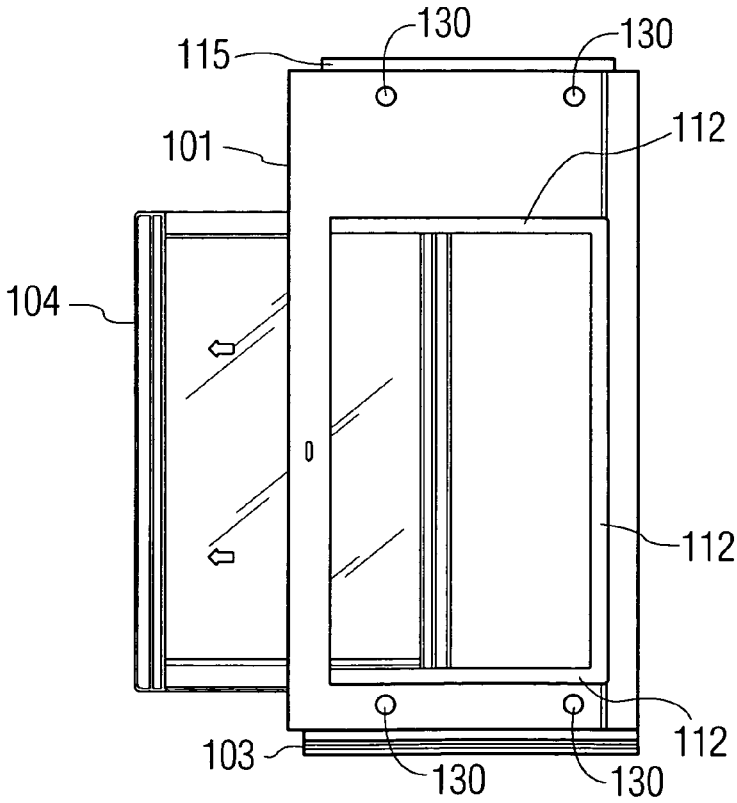
FIG. 9 is a front elevational view of the bottom module with the flap assembly cassette partially removed in the low rise or small pet configuration.

FIG. 9 shows a front elevational view of bottom module 101 with flap assembly cassette 104 partially removed by sliding back out of flap assembly cassette channel 114 (see FIG. 8), interior to bottom module 101.

Figure 10:
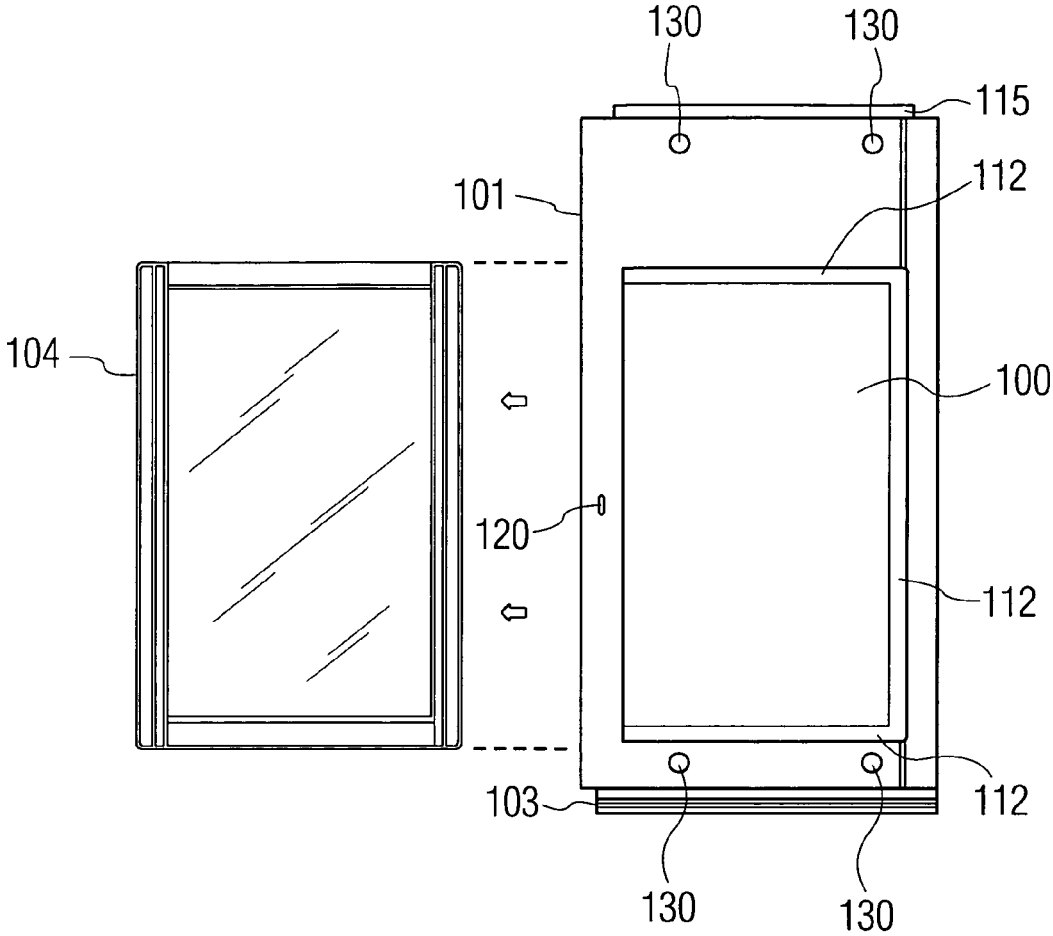
FIG. 10 is a front elevational and exploded assembly view of the bottom module and the flap assembly cassette with the flap assembly cassette completely removed from the bottom module in the low rise or small pet configuration.

FIG. 10 shows a front elevational and exploded assembly view of bottom module 101 in the small pet configuration where the security panel track 112 is an integral part of, frames three sides of the portal opening in bottom module 101, and has one portion located close to the lowermost portion of bottom module 101. The bottom rubber weather seal 103 is attached via mounting tongue 115 (see FIG. 11A) located at the top and bottom ends of bottom module 101. The space between security panel track 112 and the bottom rubber weather seal 103 is known as the "portal rise," which is the distance the pet must traverse to clear the portal opening 100 when passing through the portal. Also, the "portal height" is the distance from the uppermost portion of portal opening 100 to the floor.

Figure 11A:
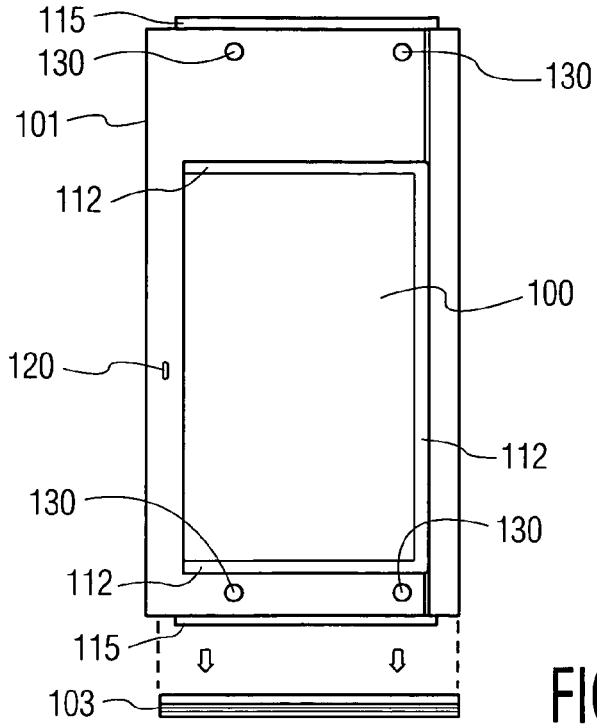
FIG. 11A is a front elevational and exploded assembly view of the bottom module in the low rise or small pet configuration with the flap assembly cassette and lower rubber weather seal removed.

FIG. 11A is a front elevational and exploded assembly view of bottom module 101 showing bottom rubber weather seal 103 removed from mounting tongue 115. This permits the bottom module 101 to be inverted to change the height of the rise and portal opening 100.

Figure 11B:
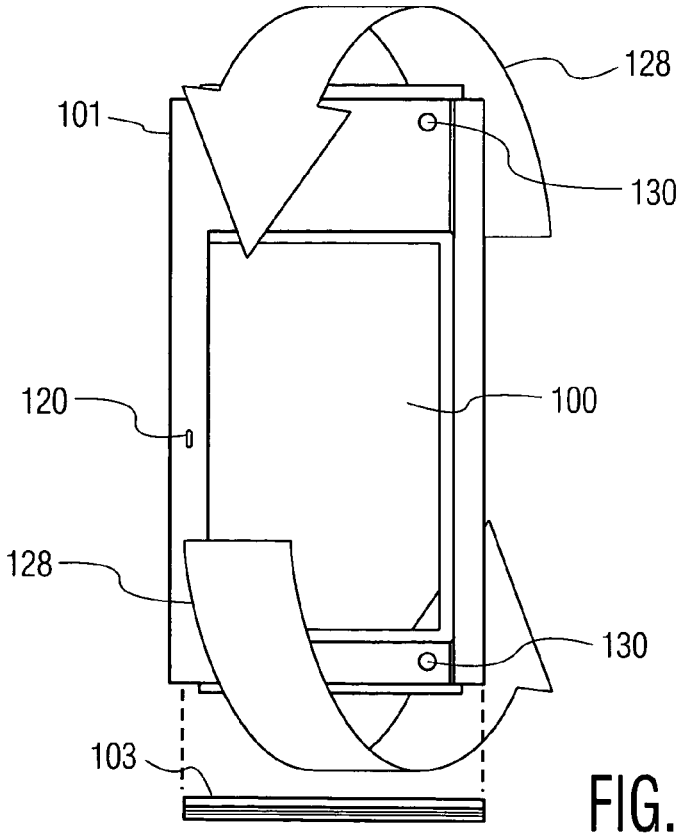
FIG. 11B is a front elevational and exploded assembly view of the bottom module with directional arrows illustrating how the bottom module is inverted with the flap assembly cassette and lower rubber weather seal removed to change the height of the rise from a small pet setting to a large pet setting.
Figure 11C:
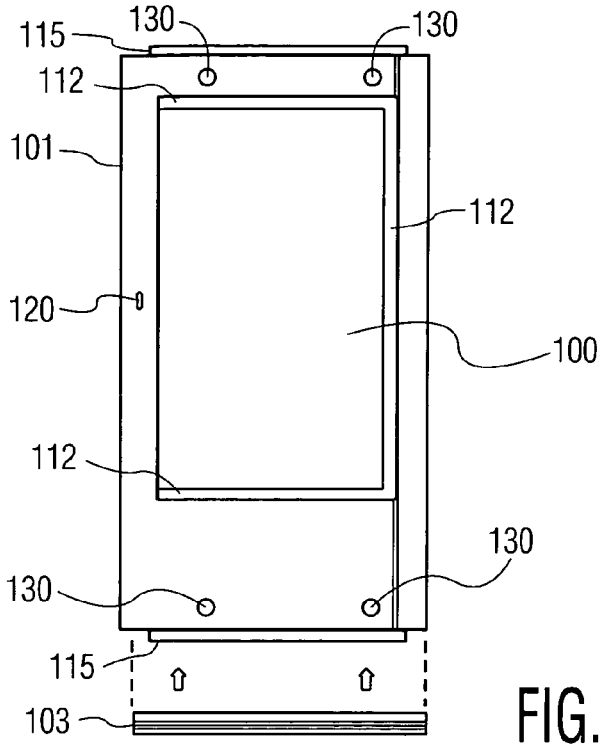
FIG. 11C is a front and exploded assembly elevational view of the bottom module in the high rise or large pet configuration with the flap assembly cassette and lower rubber weather seal removed.

FIG. 11B is a front devotional and exploded assembly view of the bottom module 101 showing how it is rotated (see arrows 128) about a vertical axis to invert bottom module 101 with the bottom rubber weather seal 103 remove to change the height of the rise and portal opening 100. Mounting tongues 115 are located on the top and bottom of module 101, but in either of the vertical orientations only the bottommost tongue 115 receives weather seal 103. FIG. 11C is a front elevational and exploded assembly view of bottom module 101 (in the large pet configuration) on with the security panel track 112 is an integral part, frames three sides of the portal opening, and is located most distant to the lowermost portion of bottom module 101. The space between security panel track 112 and bottom rubber weather seal 103 is known as the "rise " the distance the pet must traverse to clear the portal opening when passing through the portal 100. The bottom rubber weather seal 103 is shown about to be reattached to mounting tongue 115 after having changed the height of the rise, and portal opening 100. Also, a security panel lock slot 120 is shown on module 101 in FIGS. 11A, 11B and 11C, respectively.

Figure 11D:
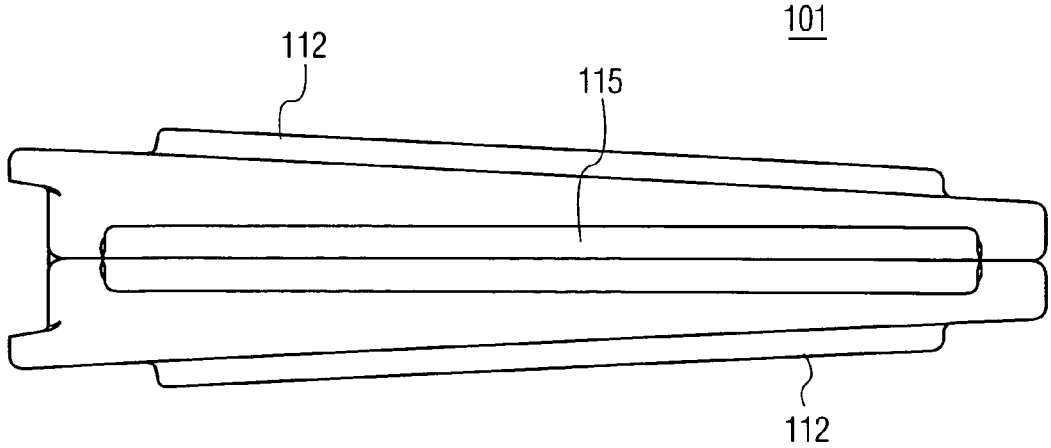
FIG. 11D is a bottom pictorial view of the bottom module of FIG. 11A, the top plan view being identical thereto.

FIG. 11D shows a pictorial view of the bottom of bottom module 101. The top view is identical. Top module 2 and center module 3 also have corresponding tapered cross sections for pet door panel 25 used with right-hand or left-hand closure sliding glass doors. In this manner, in a first horizontal orientation of modules 2, 3, and 101, the present portable pet port is configured for use with a right-hand closing sliding patio door. Alternatively, in a second horizontal orientation displaced 180° from the first horizontal orientation, the portable pet portal is configured for use with a left-hand closing sliding door. However, the present invention is not meant to be limited to tapered cross sections for modules 2, 3, and 101.

Figure 11E:
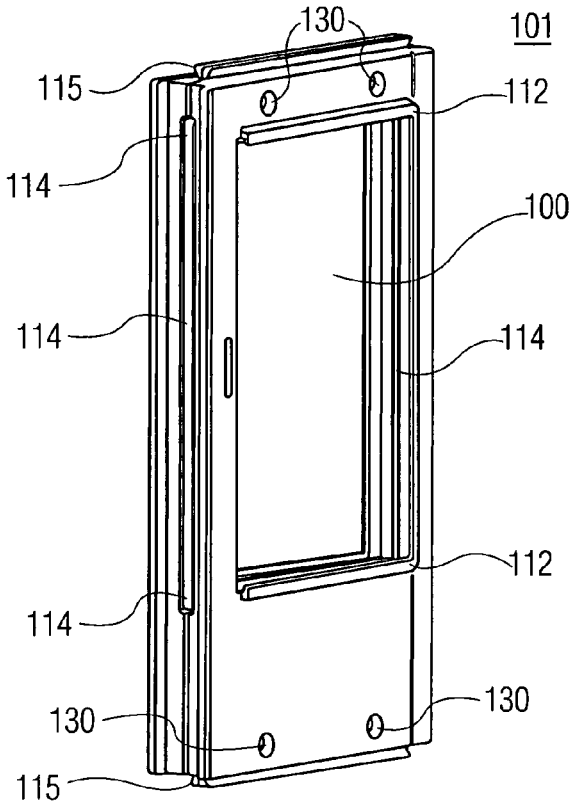
FIG. 11E is a pictorial view of the bottom module of FIG. 11A rotated slightly clockwise.

FIG. 11E is a pictorial view of the front face of bottom module 101 of FIG. 11A rotated slightly clockwise to more clearly show the flap cassette channel 114, and security panel track 112. Note that the back face (not shown) of bottom module 101 is a mirror image of the front face thereof.

Figure 12:
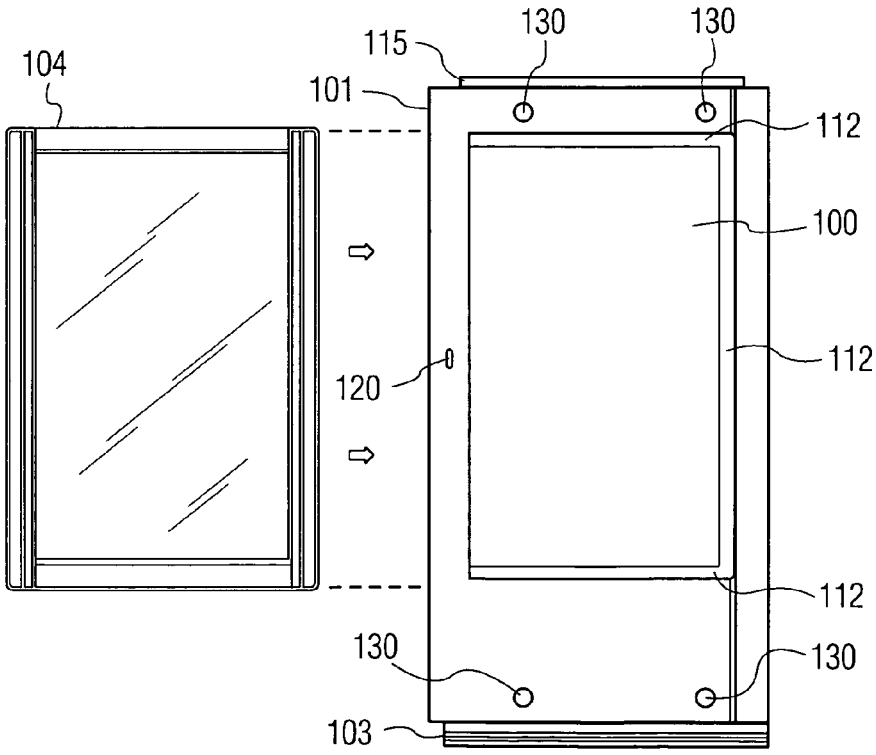
FIG. 12 is a front elevational and exploded assembly view of the bottom module with the lower rubber weather seal attached in the high rise or large pet configuration and the flap assembly cassette prior to insertion.
Figure 13:
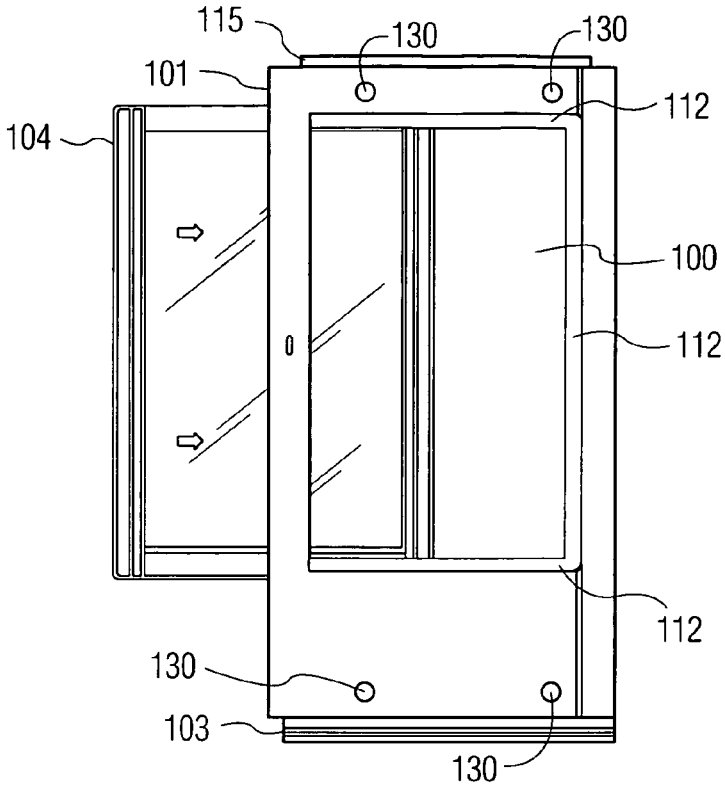
FIG. 13 is a front elevational view of the bottom module with the flap assembly cassette partially inserted in the high rise or large pet configuration.
Figure 14:
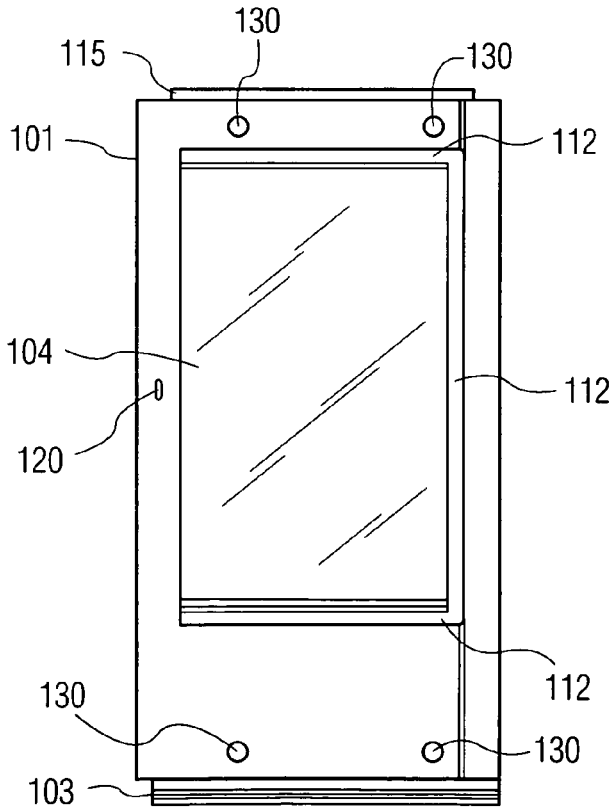
FIG. 14 is a front elevational view of the bottom module with the flap assembly completely inserted and the assembled bottom module in the high rise or large pet configuration.

FIGS. 12, 13, and 14, respectively, show front elevational views of bottom module 101 in large pet orientation or configuration with flap assembly cassette 104 removed, then partially reinserted into flap assembly cassette channel 114 (not shown) interior to bottom module 101, and finally fully inserted into bottom module 101. As previously described, by rotating bottom module 101 through 180° a small pet configuration is obtained.

Figure 15:
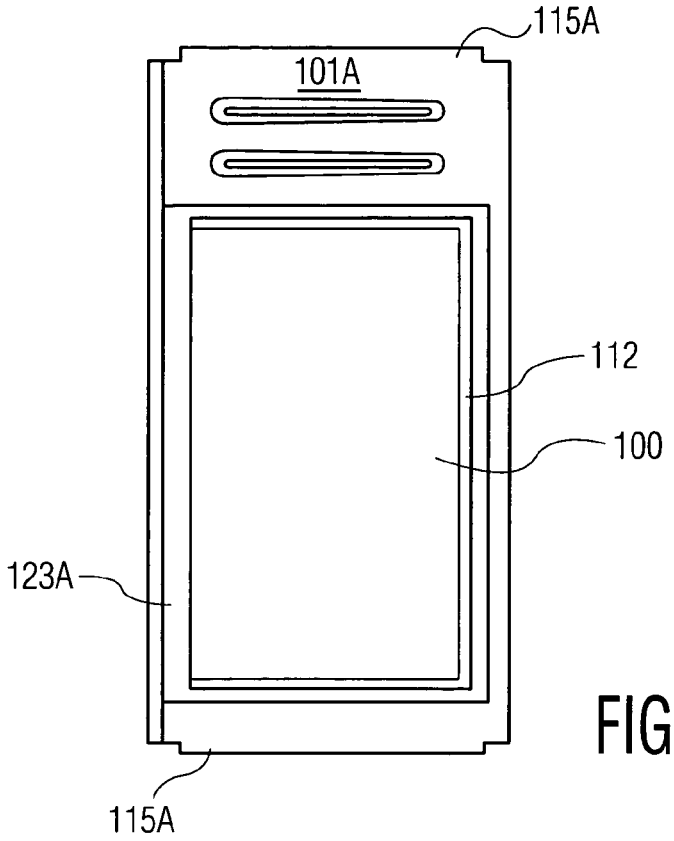
FIG. 15 is an interior side elevational view of a bottom module half 101A for one embodiment of the present invention.
Figure 16:
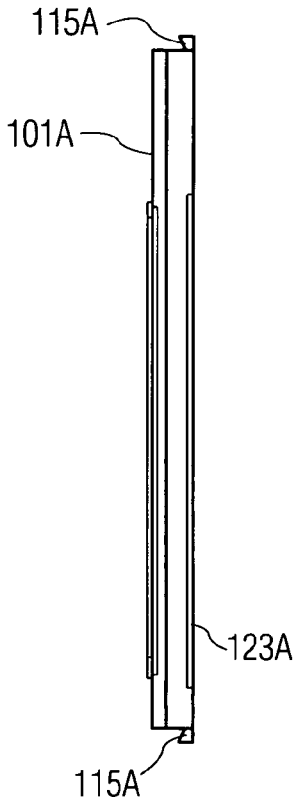
FIG. 16 is a trailing edge view of a bottom module half 101A of FIG. 15 in accordance with the present invention.
Figure 17:
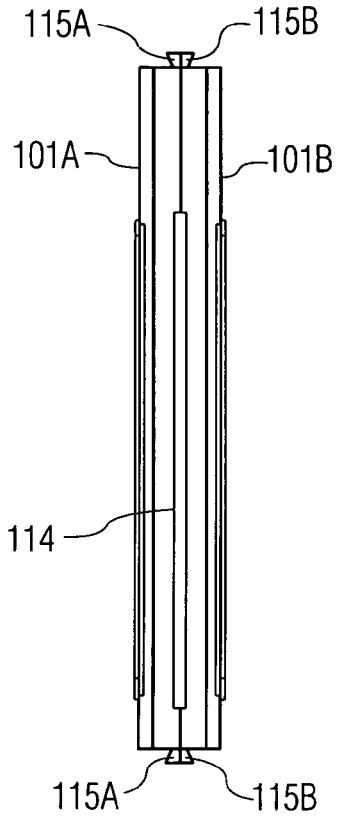
FIG. 17 is a trailing edge view of a bottom module with both halves as shown in FIGS. 15, 16, 19, and 20 joined to form the bottom module in one embodiment of the present invention.
Figure 18A:
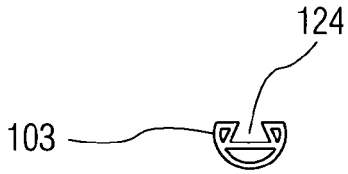
FIGS. 18A and 18B are edge and front elevational views, respectively, of the rubber bottom module weather seal.
Figure 18B:
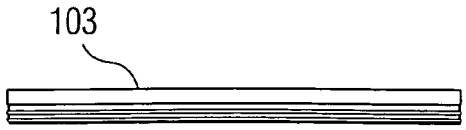
Figure 19:
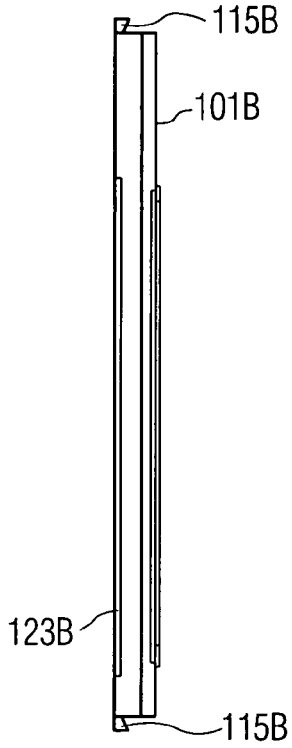
FIG. 19 is a trailing edge view of a bottom module half 101B of FIG. 20 in accordance with the present invention.
Figure 20:
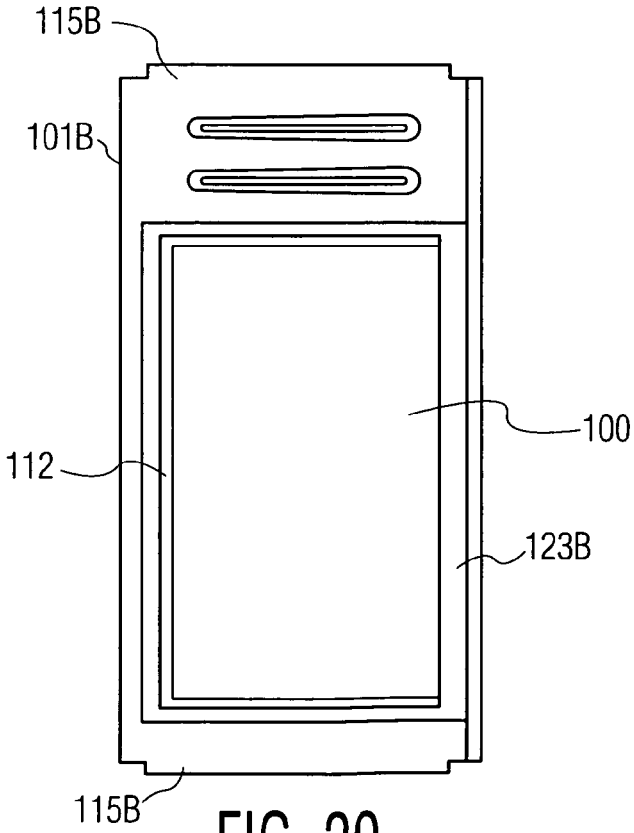
FIG. 20 is an interior side or back elevational view of a bottom module half 101B for one embodiment of the present invention.

FIGS. 15 and 16 show interior side elevational and trailing edge views, respectively, of bottom module half 101 A. Flap assembly cassette recess 123A forms one-half of flap assembly cassette channel 114 when bottom module halves 101A and 101B are joined (see FIG. 17). Security panel track recess 112 frames three sides of the portal opening 100 to permit insertion and sealing of security panel 104 (not shown). FIG. 17 is a trailing edge view of joined bottom module halves 101A and 101B forming bottom module 101. When module halves 101A and 101B are joined to form bottom module 101, flap assembly cassette recesses 123A and 123B form flap assembly cassette channel 114, and mounting tongue halves 115A and 115B form mounting tongues 115. FIGS. 18A and 18B show edge and front elevational views, respectively, of the bottom rubber weather seal 103. FIGS. 19 and 20 showing module half 101B are mirror images of FIGS. 15 and 16 showing module half 101A.

Figure 21:
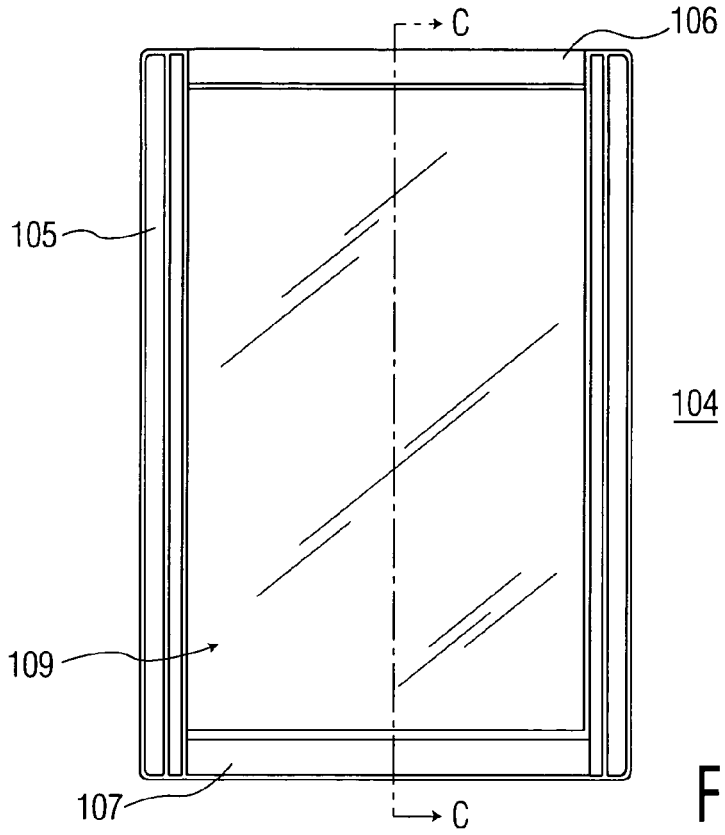
FIG. 21 is a front elevational view of a flap assembly cassette for an embodiment of the invention.
Figure 22:
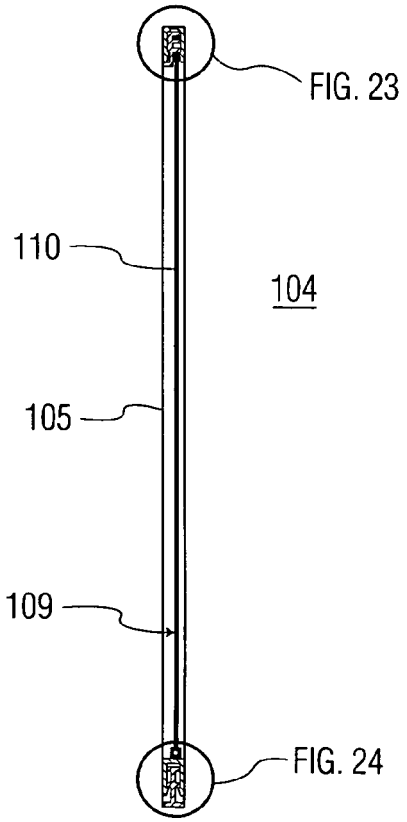
FIG. 22 is a cross sectional view taken along C-C of FIG. 21.
Figure 23:
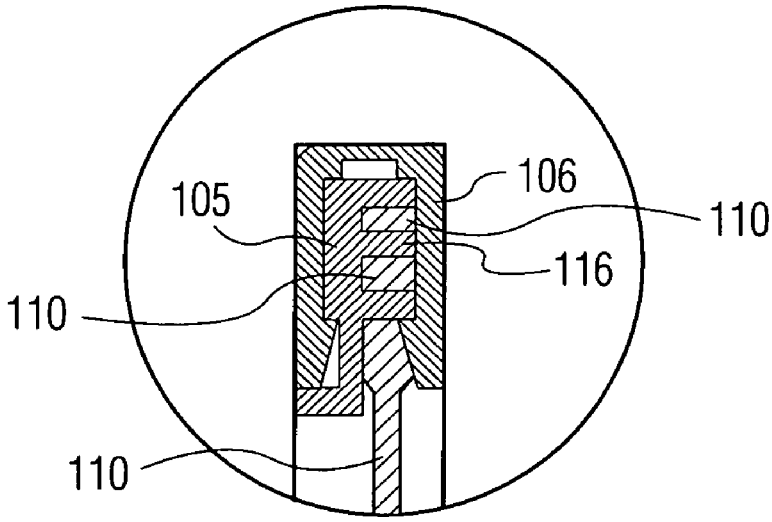
FIG. 23 is an enlarged cross sectional view of the uppermost portion of the flap assembly cassette FIG. 22.
Figure 24:
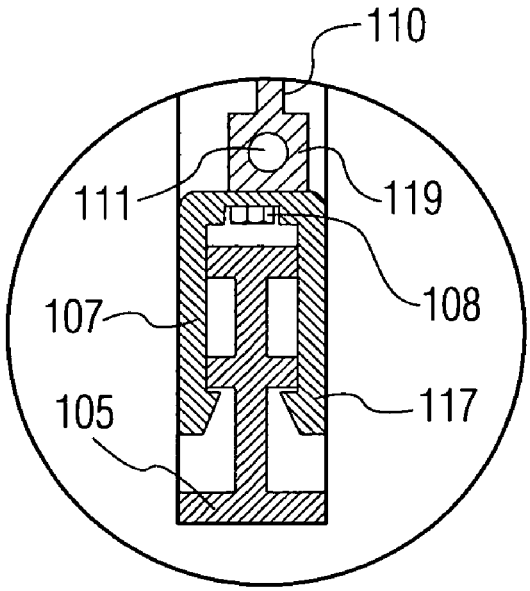
FIG. 24 is an enlarged cross sectional view of the lowermost portion of the flap assembly cassette FIG. 22.

FIG. 21 is a front elevational view of flap assembly cassette 104 showing flap assembly cassette frame 105, flap keeper 106, magnetic seal bar 107, and flap assembly 109. FIG. 22 is a cross sectional view of flap assembly cassette 104 taken along C-C of FIG. 21. FIG. 23 is an enlarged partial cross sectional view of the uppermost portion of FIG. 22 showing how the flap mounting slot 118 (not shown) in flap assembly 109 fits over flap mounting lug 116 in flap assembly cassette frame 105, and is held in place by flap keeper 106 that slides over and snaps onto flap assembly 109, flap assembly cassette frame 105 and flap mounting lug 116. FIG. 24 is an enlarged partial cross sectional view of the lowermost portion of FIG. 22 showing how magnetic seal bar 107 fits over and snaps onto magnetic seal bar stops 117 an integral part of flap assembly cassette frame 105. Magnet 108 in magnetic seal bar 107 is drawn to ferrous metal rods 111 in flap seal band 119 in the lowermost portion of flap assembly 109 to form a seal against air and water infiltration.

Figure 25:
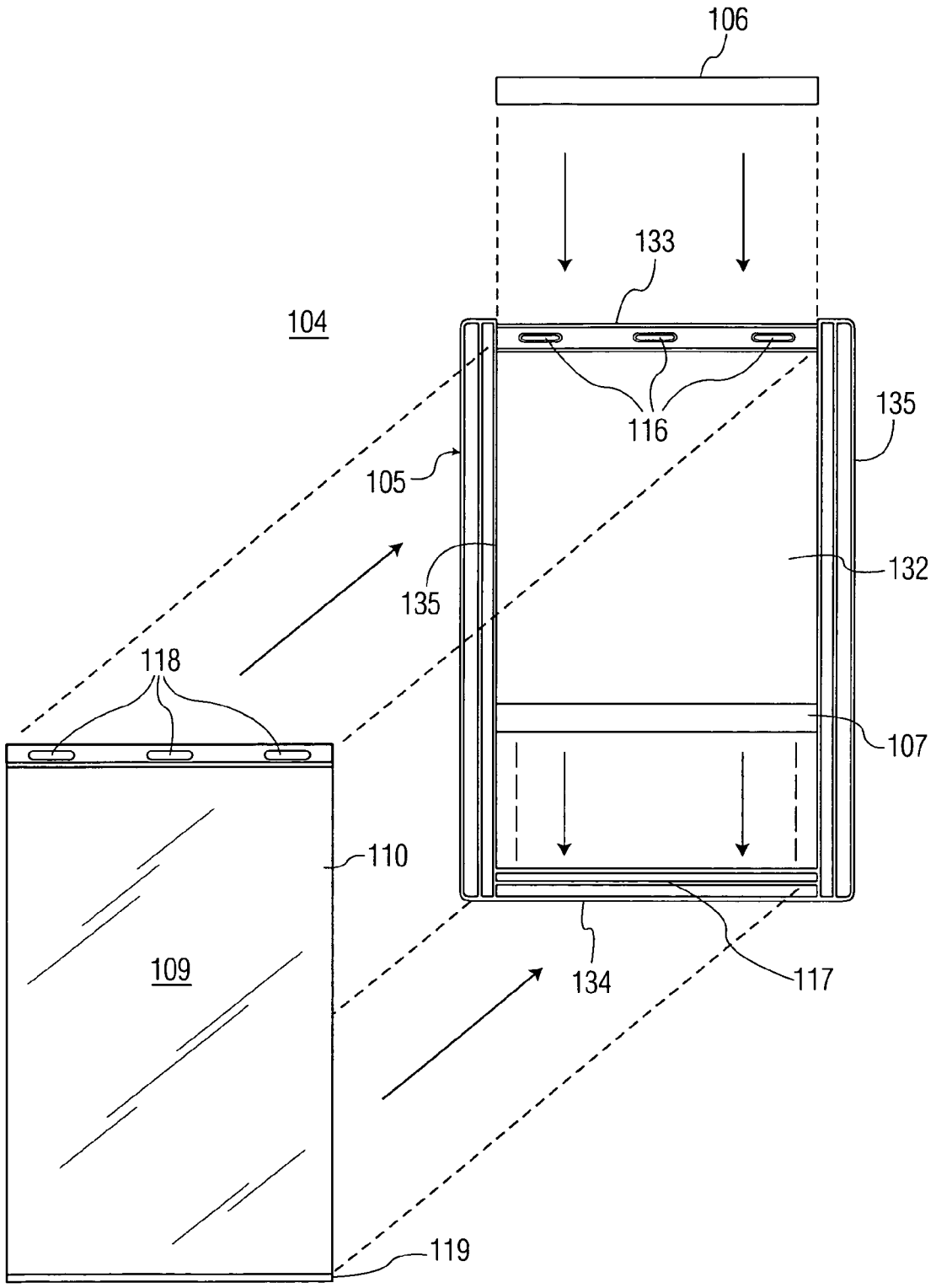
FIG. 25 is an exploded assembly view of the flap assembly cassette.

FIG. 25 is a front elevational exploded assembly view of flap assembly cassette 104 showing flap mounting slots 118 in an uppermost portion of flap 110, and a flap seal band 119 in the lowermost portion of flap 110 of flap assembly 109. Also shown are flap mounting lugs 116 in a top rail 133, and a magnetic seal bar stop 117 in a bottom rail 134 of flap assembly cassette frame 105, flap keeper 106, magnetic seal bar 107, and opposing side rails 135. Also shown is an opening or open area 132, whereby flap 110 can rotate through this opening 132 and pet portal opening 100 to permit passage of a pet whenever the flap assembly cassette 104 is installed in bottom module 101 with security panel 102 removed.

Figure 26A:
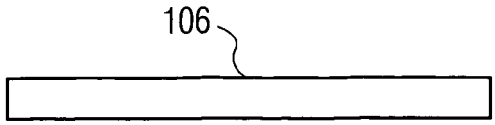
FIGS. 26A and 26B are front elevational and right side views, respectively, of a flap keeper, the left side edge view being identical to the right side.
Figure 26B:
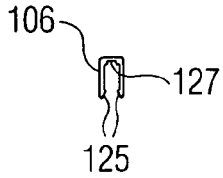

FIGS. 26A and 26B show front elevational, and edge views of flap keeper 106, respectively. Flap keeper locking tabs 125 snap over flap mounting lugs 116 in top rail 133 of flap assembly cassette frame 105.

Figure 27:
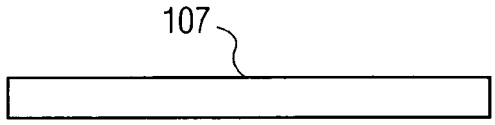
FIG. 27 is a front elevational view of a magnetic flap sealing bar.
Figure 28:
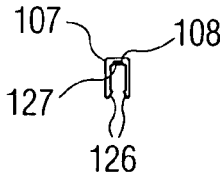
FIG. 28 is a right side edge view of the magnetic flap sealing bar of FIG. 27, the left side edge view being identical.

FIGS. 27 and 28 show front elevational, and edge views of magnetic seal bar 107, respectively. Magnets 108 fit into a groove 127 in magnetic seal bar 107 and magnetic seal bar locking tabs 126 snap over magnetic seal bar stops 117 in bottom rail 134 of flap assembly cassette frame 105.

Figure 29A:
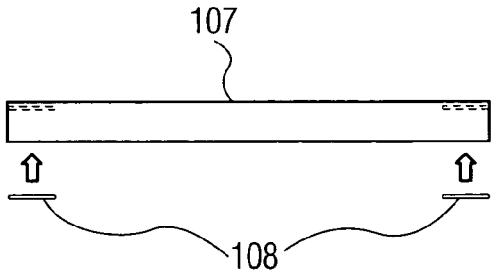
FIGS. 29A and 29B are front elevational and right side edge views, respectively, of an exploded assembly drawing of a magnetic flap sealing bar, the left side edge view being identical to the right.
Figure 29B:
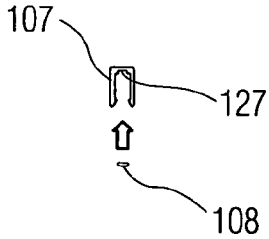

FIGS. 29A and 29 B show front elevational and edge exploded assembly views, respectively, of magnetic seal bar 107, where magnets 108 fit into and are attached in groove 127 of magnetic seal bar 107.

Figure 30A:
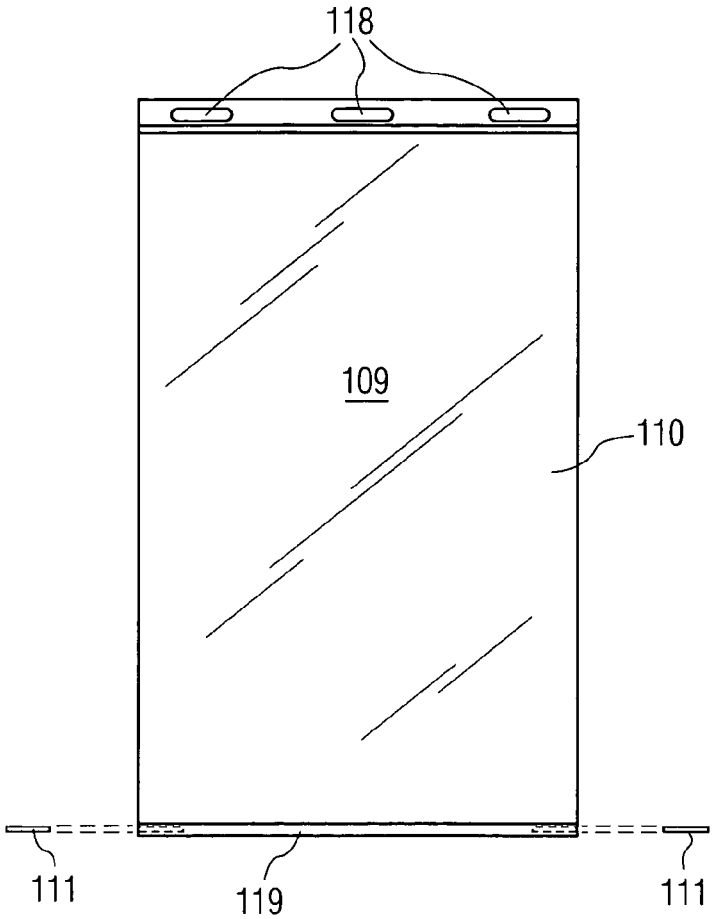
FIG. 30A is a front elevational view of an exploded assembly view of the flap.
Figure 30B:
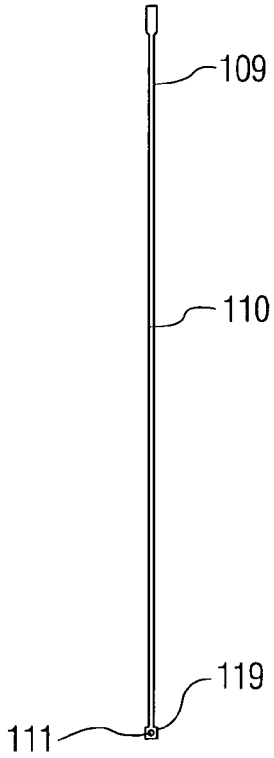
FIG. 30B is a right side edge view of the flap of FIG. 30A, the left side edge view being identical.

FIG. 30A is a font elevational exploded assembly view of flap assembly 109, showing mounting slots 118 and insertion of ferrous metal rods 111 in a flap sealing band 119 in the lowermost portion of flap 110. FIG. 30B is an edge view of flap assembly 109 showing a flap sealing band 119 with ferrous metal rods 111 inserted into flap 110.

Figure 31A:
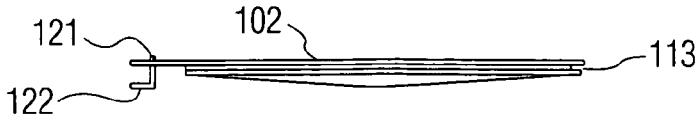
FIGS. 31A, 31B, 31C, and 31D are top, front elevational, trailing edge and leading edge views, respectively, of a security panel for one embodiment of the present invention.
Figure 31B:
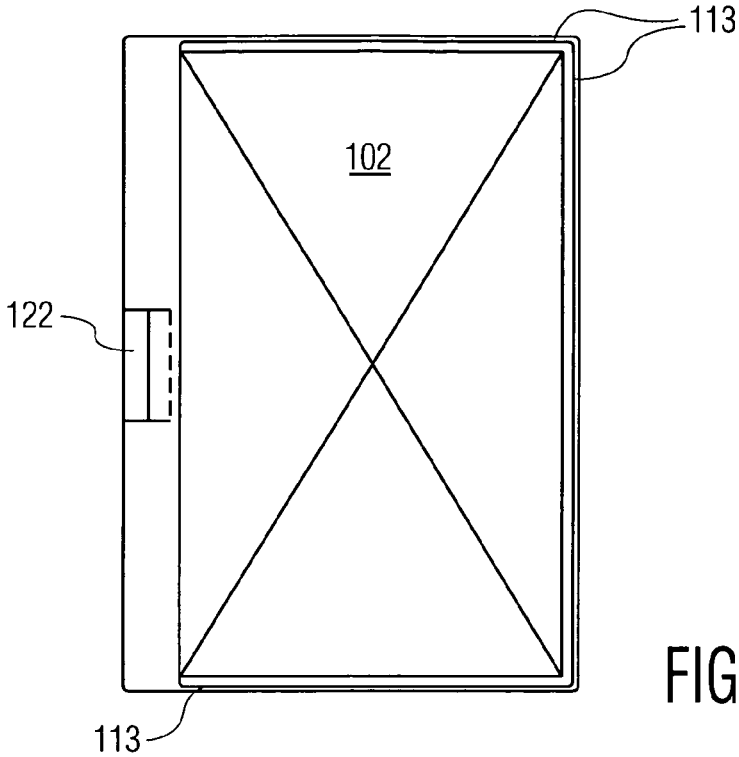
Figure 31C:
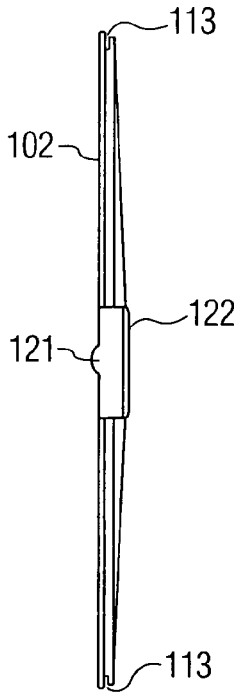
Figure 31D:
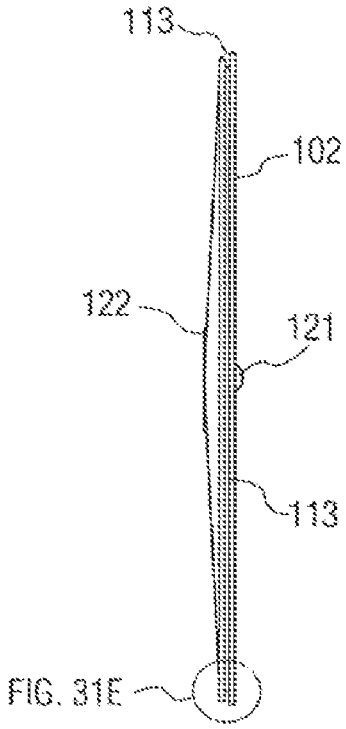
Figure 31E:
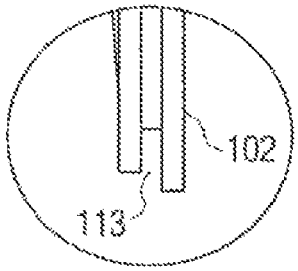
FIG. 31E is an enlarged view of the lowermost portion of the security panel FIG. 31D.

FIGS. 31A, 31B, 31C, and 31D show top, front elevational, trailing edge and leading edge views, respectively, of security panel 102 with handle 122, locking tab 121, and channel 113 on three sides. FIG. 31E is an enlarged partial trailing edge view of security panel 102 showing channel 113 that slidably fits over the security panel track 112 (see FIG. 32) framing three sides of the portal opening in bottom module 101.

Figure 32:
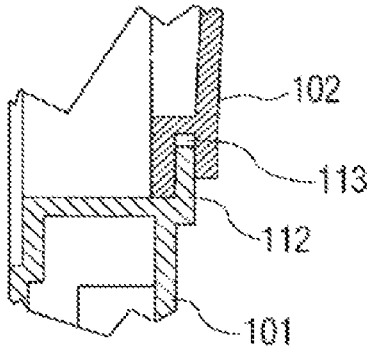
FIG. 32 is an enlarged cross sectional of the lowermost portion of the portal opening in the bottom module with the security panel installed.

FIG. 32 is an enlarged cross sectional view showing the fit of security panel track 112 in bottom module 101 to channel 113 in security panel 102.

Movement of the flap 110 will now be descried with reference to FIGS. 21 through 24. When flap 110 is pushed inward or outward by a pet, the magnetic attraction between magnet 108 and ferrous metal flap rod 111 is broken (see FIG. 24) by such forceful movement of flap 110. This causes the magnetic seal bar 107 to move downward on flap assembly cassette frame 105. Flap 110 pivots back and forth upon passage of the pet, and quickly slows to a rest position causing magnet 108 to attract flap rod 111. In turn, seal bar 107 then moves upward to create a weather seal with the bottom of flap seal band 119, as previously mentioned.

TABLE 1

| Reference Designations For The Preferred Embodiments of The Invention: | |
|---|---|
| 100 | Portal Opening; |
| 101 | Bottom Module (101A and 101B); |
| 102 | Security Panel; |
| 103 | Bottom Rubber Weather Seal; |
| 104 | Flap Assembly Cassette; |
| 105 | Flap Assembly Cassette Frame; |
| 106 | Flap Keeper; |
| 107 | Magnetic Seal Bar; |
| 108 | Magnet; |
| 109 | Flap Assembly; |
| 110 | Flap; |
| 111 | Ferrous Metal Flap Rods; |
| 112 | Security Panel Track; |
| 113 | Security Panel Channel; |
| 114 | Flap Assembly Cassette Channel; |
| 115 | Mounting Tongue (115A and 115B); |
| 116 | Flap Mounting Lug; |
| 117 | Magnetic Seal Bar Stop; |
| 118 | Flap Mounting Slot; |
| 119 | Flap Seal Band; |
| 120 | Security Panel Lock Slot; |
| 121 | Security Panel Lock Tab; |
| 122 | Security Panel Handle; |

TABLE 1-continued

| Reference Designations For The Preferred Embodiments of The Invention: | |
|---|---|
| 123 | Flap Assembly Channel Recess (123A and 123B); |
| 124 | Bottom Rubber Weather Seal Mounting Groove; |
| 125 | Flap Keeper Locking Tabs; |
| 126 | Magnetic Seal Bar Locking Tabs; |
| 127 | Magnetic Seal Bar Magnet Groove; |
| 132 | Opening; |
| 133 | Top Rail; |
| 134 | Bottom Rail: |
| 135 | Opposing Side Rails. |

Although many embodiments of the present invention have been shown and described they are not meant to be limiting. Those of skill in the art may recognize certain modifications to these embodiments, which modifications are meant to be covered by the spirit and scope of the appended claims. For example, the bottom module 101 can be reconfigured for permitting its installation into a standard exterior door for providing a pet portal thereon.

What I claim is:

1. A portable pet portal insert for use with sliding patio doors, comprising:

independent top, center, and bottom modules, each having a top, bottom, front, back, right side and left side portions;

a first interlocking mechanism affixed to the bottom of said top module;

a second interlocking mechanism affixed to the top of said center module, for interacting with said first interlocking mechanism to permit said top and center modules to be removably secured together;

a third interlocking mechanism affixed to the bottom of said center module;

a fourth interlocking mechanism affixed to the top of said bottom module, for interacting with said third interlocking mechanism to permit said center and bottom modules to be removably secured together;

said top, center, and bottom modules when assembled or secured together being configured to be inserted and retained between a leading edge of a sliding patio door, a vertical edge of a frame retaining the latter, and within top and bottom tracks of said frame;

a flap assembly cassette including:

a frame including an opening between top and bottom rails, and opposing side rails;

a flap;

means for securing said flap to said frame for permitting pivotal movement of said flap through said opening, for the ingress and egress of a pet; and a security panel including:

a second frame;

a first channel formed on top, bottom, and leading edge portions of said second frame, the first channel extending on the leading edge portion between the top and bottom portions;

a handle secured proximate a trailing edge portion of said second frame; and said bottom module further including:

a third frame having a top, a left side edge, a right side edge, a bottom, a front face, a back face opposing said front face, and a cutout portion therebetween serving as a pet portal;

an elongated channel cut through a central portion of said left side edge, with upper and lower portions of the second channel extending into interior top, bottom, and right side edge portions of said cutout portion, for slideably receiving top, bottom, and leading edge portions of said flap assembly cassette when inserted through said channel into said third frame, with said flap positioned to move into and out of said cutout portion, thereby permitting said flap assembly cassette to be selectively installed into or removed from said bottom module;

a first track formed on said front face proximate the top, bottom, and right side edge portions of the cutout portion, with free ends of the track being proximate said elongated channel opening into the cutout portion, said first track being adapted for slideably receiving the first channel of said security panel; thereby permitting said security panel to be selectively secured upon said bottom module for covering said cutout portion, or removed from said bottom module;

a second track formed on said back face, said second track being a mirror image of said first track, and being adapted for receiving the channel of said security panel.

2. The portable pet portal insert of claim 1, wherein said flap assembly cassette flap securing means further includes:

a plurality of spaced apart protruding mounting lugs on the top rail of said first frame thereof;

a plurality of spaced apart mounting slots in a top portion of said flap for receiving and mounting upon said plurality of protruding mounting lugs of said first frame, respectively; and flap keeper means for retaining said flap on the top rail of said frame.

3. The portable pet portal insert of claim 1, wherein said flap assembly cassette further includes:

a plurality of ferrous metal rod affixed to a bottom portion of said flap;

a magnetic seal bar;

means for mounting said magnetic seal bar onto the bottom rail of said first frame, in a manner permitting limited vertical movement thereof, whereby when said flap is at rest, magnetic attraction between said seal bar and the ferrous metal rods in the bottom of said flap causes said seal bar to move upward against the bottom of said flap to provide a weather seal, and when a pet pushes against said flap moving it away from said seal bar, said seal bar moves downward permitting free pivotal movement of said flap.

4. The portable pet portal insert of claim 3, further including a weather seal removably mounted upon the bottom of said frame of said bottom module.

5. The portable pet portal insert of claim 1, further including:

a weather seal removably mounted upon the bottom of said frame of said bottom module.

6. The portable pet portal insert of claim 1, wherein said bottom module further includes:

the cutout portion of said frame being offset vertically to provide in a first vertical orientation a rise and height for a relatively small pet, and in the second vertical orientation rotated 180° from the first vertical orientation a rise and height for a relatively large pet.

7. The portable pet portal insert of claim 1, wherein said bottom module is configured for in a first horizontal orientation providing for use with a right-hand closing sliding patio door, and in a second horizontal orientation displaced 180° from the first horizontal orientation providing for use with a left-hand closing sliding patio door.

8. A pet portal module comprising:

a main frame having a front face, a back face opposing said front face, a top, a left side edge, a right side edge, a bottom, and a cutout portion therebetween serving as a pet portal;

said main frame being adapted for installation in a door;

a flap assembly cassette including:

a frame including a cutout portion between top and bottom rails, and opposing side rails;

a flap; and means for securing said flap to said top rail for providing pivotal movement through said cutout portion; and said main frame and said flap assembly cassette each being adapted for permitting said flap assembly cassette to be slideably inserted into said main frame or removed therefrom, whereby when the flap assembly cassette is inserted into said main frame, a pet can freely push said flap in a direction to provide ingress or egress through said cutout portion; wherein said main frame further includes: an elongated channel cut through a central portion of either one of said left side or right side edges, with upper and lower portions of the channel extending into interior top, bottom, left and right side edge portions of said cutout portion, for slideably receiving top, bottom, and leading edge portions of said flap assembly cassette, thereby permitting said flap assembly cassette to be selectively installed into or removed from said main frame.

9. The pet portal module of claim 8, further including:

a security panel dimensioned to overlap the cutout portions of both said main frame, and said frame of said flap assembly cassette; and said security panel and said main frame being adapted to permit said security panel to be removably inserted onto said main frame on an interior face thereof, for preventing the pet a means of ingress or egress.

10. The pet portal module of claim 9, wherein said main frame further includes:

a first track formed on said front face about the circumference of the cutout portion, with free ends of the track being proximate one of said left and right side edges; and a second track formed on said back face, said second track being a mirror image of said first track;

said security panel being adapted for removable mounting on either one of said first and second tracks of said main frame, thereby permitting said security panel to be selectively installed into or removed from said main frame.

11. The pet portal module of claim 10, wherein said security panel further includes:

a first channel having portions formed on top, bottom, and leading edge portions, respectively, of said security panel, the potions of the first channel on the leading edge portion extending between the top and bottom portions; and said first channel being configured for slideably mating with either one of said first and second tracks of said main frame.

12. The pet portal module of claim 8, wherein the cutout portion of said main frame is offset vertically to provide in a first vertical orientation a rise and height for a relatively small pet, and in a second vertical orientation rotated 180° from the first vertical orientation a rise and height for a relatively large pet.

13. The pet portal module of claim 8, wherein said main frame is configured for in a first horizontal orientation providing for use with a right-hand closing door, and in a second horizontal orientation 180° displaced from the first horizontal orientation providing for use with a left-hand closing door.

14. The pet portal module of claim 8, wherein said main frame further includes:

a first track formed on said front face about the circumference of the cutout portion, with free ends of the track being proximate one of said left side edge; and a second track formed on said back face, said second track being a mirror image of said first track;

said security panel being adapted for removable mounting on either one of said first and second tracks of said main frame, thereby permitting said security panel to be selectively installed into or removed from said main frame.

15. The pet portal module of claim 14, wherein said security panel further includes:

a first channel having portions formed on top, bottom, and leading edge portions, respectively, of said security panel, the channel on the leading edge portion extending between the top and bottom portions; and said channel being configured for slideably mating with either one of said first and second tracks of said main frame.

16. The pet portal module of claim 8, wherein said flap securing means includes:

a plurality of spaced apart protruding mounting lugs on the top rail of said frame of the flap assembly cassette;

a plurality of spaced apart mounting slots in a top portion of said flap, for receiving and mounting upon said plurality of protruding mounting lugs of said frame of the flap assembly cassette; and flap keeper means for retaining said flap on the top rail of said main frame.

17. The portable pet portal module of claim 8, wherein said flap assembly cassette further includes:

a plurality of ferrous metal rod affixed to a bottom portion of said flap;

a magnetic seal bar;

means for mounting said magnetic seal bar onto the bottom rail of said frame of said flap assembly cassette, in a manner permitting limited vertical movement thereof, whereby when said flap is at rest, magnetic attraction between said seal bar and the ferrous metal rods in the bottom of said flap causes said seal bar to move upward against the bottom of said flap to provide a weather seal, and when a pet pushes against said flap moving it away from said seal bar, said seal bar moves downward permitting free movement of said flap.

* * * * *